United States Patent [19]

Schieser et al.

[11] 4,283,901

[45] Aug. 18, 1981

[54] CONTINUOUS ROTARY MACHINE FOR UNCAPPING, FILLING AND RECAPPING FLEXIBLE BAGS HAVING SEPARABLE CAPS

[75] Inventors: Warren J. Schieser, Dublin; Stanley E. Vickers, Hideaway Hills, both of Ohio

[73] Assignee: Liqui-Box Corporation, Columbus, Ohio

[21] Appl. No.: 105,624

[22] Filed: Dec. 20, 1979

[51] Int. Cl.[3] ..... B65B 3/17; B65B 3/30

[52] U.S. Cl. ..... 53/75; 53/272; 53/300; 53/381 A; 53/503; 53/512

[58] Field of Search ..... 53/512, 381 A, 268-275, 53/282, 281, 319, 300, 276, 75, 570, 503, 493, 55; 141/135, 101, 154, 350, 114, 10, 140, 162, 313, 317

[56] References Cited

U.S. PATENT DOCUMENTS

| | | | |
|---|---|---|---|
| 3,105,525 | 10/1963 | Boucher | 141/101 X |
| 3,242,951 | 3/1966 | Cure et al. | 141/350 |
| 3,377,775 | 4/1968 | Mattimoe et al. | 53/381 A |
| 3,427,646 | 2/1969 | Scholle | 53/281 |
| 3,447,281 | 6/1969 | Buford et al. | 53/381 A X |
| 3,708,952 | 1/1973 | Schulze et al. | 53/512 |
| 3,837,378 | 9/1974 | Kanki et al. | 53/281 X |
| 4,114,347 | 9/1978 | Morris et al. | 53/300 |
| 4,120,134 | 10/1978 | Scholle | 53/512 X |

OTHER PUBLICATIONS

B-Bar-B, Inc., "The B-Bar-B Rotary Filler, Model 6015 RM", Dairy and Ice Cream Field, May, 1978.

R. W. Coughlin, "Filling of Still Liquids", Modern Packaging Encyclopedia, 1970.

Paul F. Gillis, Filling Liquids and Semiliquids, and "Form-Fill-Seal Equipment", Modern Packaging Encyclopedia, Dec., 1976.

*Primary Examiner*—James F. Coan

*Attorney, Agent, or Firm*—William V. Miller

[57] ABSTRACT

A continuous motion high-speed rotary machine of the turret type which has a plurality of angularly spaced filler heads thereon, each equipped with movable uncapping and capping means and a movable filler nozzle. As the turret rotates continuously, an individual bag spout is partially inserted into the approaching filler head. These bags are of the flexible type, each having a spout with a removable cap pressed thereon. The individual bags may be presented to the successive continuously-moving filler heads automatically or manually. A control system is provided on the machine which includes means for sensing the presence of the partially-inserted capped spout as the spout is clamped in the head. The movable uncapping and capping means on the head is then actuated to remove the cap and move the filler nozzle into cooperation with the clamped spout. A vacuum system on the machine then functions, through the nozzle, to pull vacuum through the spout on the bag to facilitate filling. Then the bag is filled through the nozzle. A safety arrangement is provided so that if there is no bag in position and, therefore, no bag vacuum detected, the fill will not start. A flow meter, which is part of the control system, determines the amount of fill and stops it when a predetermined volume has been supplied. The control system further functions so that immediately upon completion of the fill, if nitrogen is desired to aid in preservation, it is injected through the bag spout simultaneously with interruption of the flow of filling liquid. Then, the capping and uncapping means is moved so as to move the fill nozzle away from the spout and reapply the cap. Finally, the capped bag spout is ejected from the filler head, as the filled bag is discharged from the machine. Safety means is provided to prevent any bag from being subjected to the filling cycle more than once. Additional safety means is provided for stopping the rotation of the turret if the bag is not ejected from the filler head. All of the above operations are accomplished as the heads swing continuously with the rotating turret through a predetermined arc of movement.

50 Claims, 31 Drawing Figures

FIG. 20
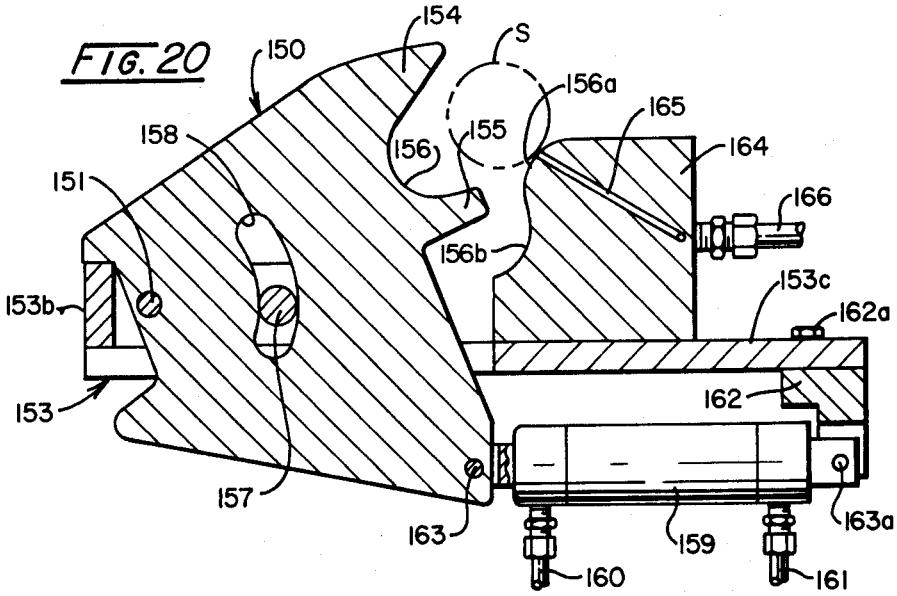
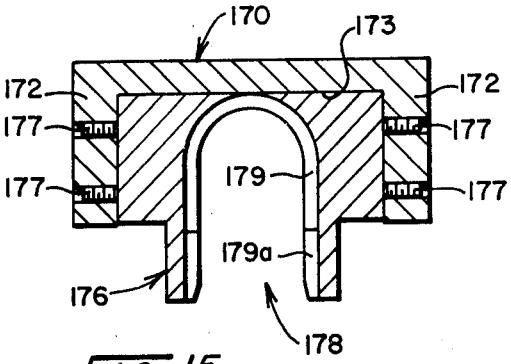
FIG. 15
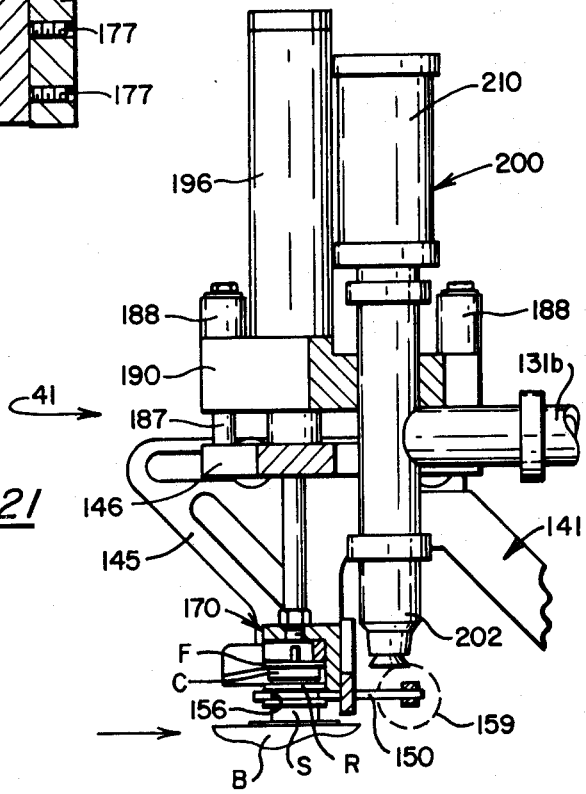
FIG. 21

19
198
224
222
196
200
228
41
207
206
187
187
188
188
146a
192
190
200a
191
203
204
193
LVI
194
195
148
147
148
147
146
131b
144
144
142
141
175b
175
212
202
175a
174
202a
176
174a
213
166
153d
161
150a
157
150
19
153c
159
162a
162

225
226
228
227
229
230
231
232
233
234
238
239b
TO MOTOR 71
239c
237
TO MOTOR 235
239
239a
232a
RS1
SW2
240
48
241
245
OUT
-V
IN-2
C
IN-1
12
5
6
2
14
17
18
19
7
16
13
242
243
P/E
SW3
246
AV1
244

CONTINUOUS ROTARY MACHINE FOR UNCAPPING, FILLING AND RECAPPING FLEXIBLE BAGS HAVING SEPARABLE CAPS

BACKGROUND OF THE INVENTION AND PRIOR ART

This invention relates to the filling of flat flexible bags, each of which is formed from plastic film and is provided with a spout, of semi-rigid plastic, through which the bag is both filled and emptied. This type of bag is usually supplied flat with a cap in position on its spout, the cap being applied to the spout by an axial inward push on the cap and being removable by an axial outward pull thereon, facilitated by peripheral flanges or ribs provided on both the cap and the spout.

Automatic filling machines for liquids and semi-liquids are generally provided in the form of in-line and rotary fillers. The rotary fillers are most commonly in use because they are for the most part continuous motion machines which operate more smoothly at a high capacity and have a minimum number of parts. The automatic rotary fillers now commonly in use are generally designed to handle and fill rigid or semi-rigid containers which are handled by conventional means such as augers, star wheels, empty containers pushing filled ones, etc. Also, the rigid or semi-rigid containers are often used as the measuring means in filling and controlling the filling operation. Obviously, the flat flexible bags to be filled according to this invention cannot be handled by such conventional means and cannot be used as the measuring means or control means to filling.

Automatic machines now in use for filling flexible containers are generally designed for filling pouches, which are usually made of plastic film or foil and do not have spouts. Pouches are frequently produced and filled on the same machine, commonly known in the trade as form-fill machines, and pouches made on such machines are usually quite small, starting at a fraction of an ounce and usually include piston-displacement measurement or timed fill. Obviously, such machines would not be suitable for filling the relatively large spouted flexible bags starting at about four liters, with which the present invention is concerned. One prior art machine is designed to fill flexible spouted bags but has a single fixed filler head and is not a continuous rotary filler.

SUMMARY OF THE INVENTION

This invention relates to a high-speed continuous rotary filling machine which is adapted to fill flexible containers which are presented thereto as individual bags. Each bag is provided with a spout which is used both in filling the bag and dispensing its contents. Each bag is ordinarily supplied with a seperable cap in place on its spout which is normally frictionally held in place, but which must be removed for filling and be replaced after filling. This is accomplished by applying axial outward pressure to remove the cap and inward axial pressure to replace the cap. The bag spout is usually provided with a pair of axially-spaced peripheral flanges or ribs and the cap is usually provided with a similar flange or rib to facilitate removal and replacement of the cap by relative axial movement of the cap and spout. Although, this invention is particularly applicable to this type of container with cap, there are various features of the invention not necessarily limited thereto.

According to this invention, a machine is provided which comprises a turret rotatable about a vertical axis. Means is provided for driving this turret continuously at high speed. The turret carries at angularly-spaced intervals around its axis, filler heads which receive individual bags, remove the caps thereof, supply vacuum if desirable, fill the bags, supply nitrogen if desirable, and then replace the caps, all of these operations being accomplished during the continuous rotary movement of the turret a predetermined arc or angle of travel, with each bag individually resting in a stationary position on a table carried by the continuously rotating turret. Each filler head is vertically disposed and includes spout-engaging clamp means into which the cap-carrying bag spout is partially inserted as the head is moved continuously past a loading position. This actuates the automatic control system on the machine which controls all the operations that are performed as the head moves through the predetermined arc on the turret to a discharge position. This system is preferalby mainly pneumatic, at the filler heads, instead of electronic because of moisture conditions usually encountered at this location, both in use and cleaning of the machine. As the partially-inserted bag spout is sensed by the control system, the spout is clamped and is positioned in a fixed lateral or radial and axial position before cap removal. The head is provided with simultaneously vertically and laterally or radially movable capengaging means which engages the cap, pulls it vertically from the bag spout and moves it in a combined vertical and lateral motion out of alignment with the bag or spout. The head is further provided with a filler nozzle, equipped with a liquid flow-control valve, which is mounted thereon for vertical and lateral or radial movement. As the cap is raised from the bag spout by the cap-engaging means, this causes the nozzle to be moved with a combined lateral and vertical movement, so it moves horizontally and then downwardly into the bag spout. The nozzle is equipped with a vacuum connection and the control system may start the application of vacuum. Then, the control system opens the filler valve to start the fill and if no bag spout is present, and if vacuum is to be used and no vacuum can be detected, a safety arrangement acts so that the fill will not start. When the filling is complete, as determined by a flow meter which provides a predetermined volume, and the fill valve closes, nitrogen may be injected through the filling valve, if desired as it closes. When the filler valve is closed, the control system moves the cap-engaging means to raise the filler nozzle and move it horizontally out of alignment with the bag spout and to lower the cap by a combined lateral and vertical movement onto the spout. Safety control means is provided for each head to reset the control circuit after its full bag has been discharged to prevent the bag from being subjected to the filling cycle more than once, if it is not ejected. The control system actuates ejecting means which ejects the spout of the filled bag from its clamping means only when fill is complete. Also, if a bag is not ejected, safety control means, beyond the discharge position and before the loading position acts, to stop the rotation of the turret. All of these operatins, as indicated, are accomplished during the high-speed continuous rotary movement of the heads on the turret through a predetermined arc from a loading position to a discharge position. During this entire movement, the bags are completely supported by the support tables or platforms, in a stationary position thereon, one which is located beneath each filler head and extends radially from the turret. Each table is pivoted at its inner edge for vertical swinging movement and its vertical position is suitably controlled so that while the bag spout is held in the clamping means of the head, the cooperating table is in horizontal supporting position for the bag but when the spout of the filled bag is ejected, the support table drops and permits discharge of the filled bag.

An automatic bag feed may be provided, for receiving bags in continuous strip form, successively separating the bags into individual bags, and presenting each bag spout for engagement by the clamping means on the continuously moving head on the turret as it moves past the automatic bag feeder. However, individual bags may be presented manually to the bag spout clamping means as they move successively past the loading position.

BRIEF DESCRIPTION OF THE DRAWINGS

The best mode contemplated in carrying out this invention is illustrated in the accompaying drawings in which:

FIG. 15 is a horizontal sectional view taken along line 15—15 of FIG. 14;

FIG. 20 is a horizontal sectional view taken along line 20—20 of FIG. 14 and showing schematically the partial insertion of the capped spout into the clamping means of the head;

FIG. 12 is a schematic view, partly in side elevation and partly in section, showing the capped bag spout initially moved into the head;

DETAILED DESCRIPTION OF THE INVENTION

In the foregoing description, the machine is described with reference to the filling of spouted flexible bags with liquids. However, it is to be understood that the bags may be filled with other substances. Also, the bag spout is shown as carrying a specific type and size of cap but it is to be understood that various types and sizes of caps may be on the bags to be filled by this machine and certain parts of each head can be removed and replaced accordingly. Furthermore, various types and sizes of bag spouts may be handled by the machine with substitution of different parts on the clamping means on each head.

Figure 22:
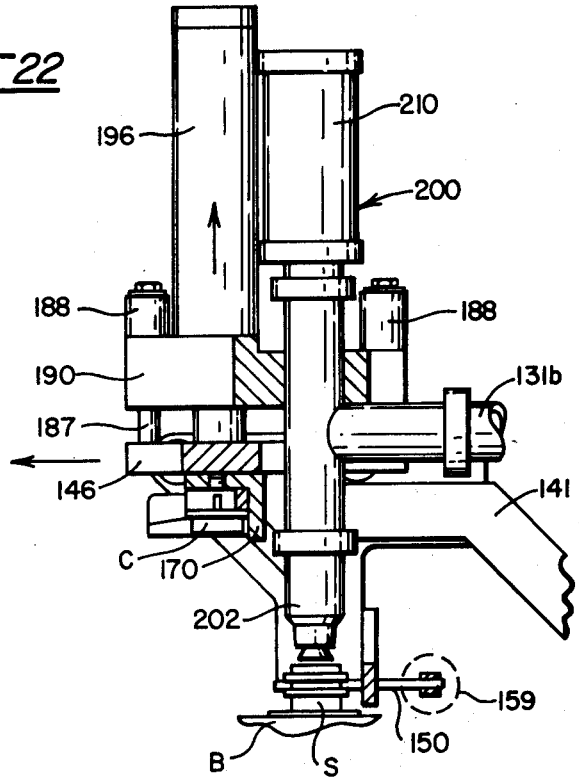
FIG. 22 is a similar view showing the uncapping and capping means of the head moving outwardly and upwardly to remove the cap from the bag spout and to move the nozzle over the spout.
Figure 23:
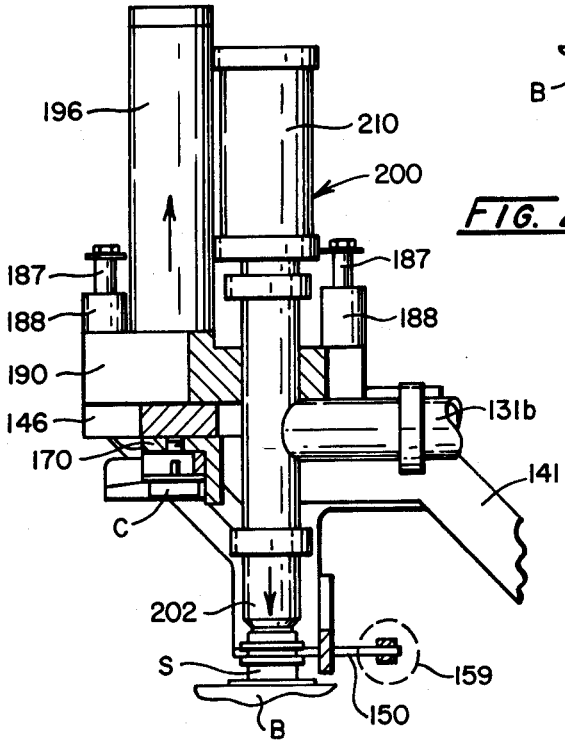
FIG. 23 is a similar view but showing the nozzle moved into axial alignment with and down into the spout into final filling position.

With specific reference to the drawings, the continuous high-speed rotary filler machine of this invention is illustrated generally in FIGS. 1 to 4, inclusive, and details of the construction of it are illustrated in FIGS. 5 to 25, inclusive. As indicated previously, the machine is in the form of a turret, indicated generally by the numeral 40, rotatable about a central vertical axis and carrying a plurality of filler heads 41 which are disposed at angularly spaced positions around the turret. Each head 41 is adapted to receive a single bag B and fill it with liquid during continuous travel of the bag with the head from a loading position to a discharge position. Also as indicated previously and as shown in FIGS. 21 to 23. each bag usually has a spout S and a removable cap C. In the example shown, six heads are provided but the machine may be designed with any number of heads.

Figure 10:
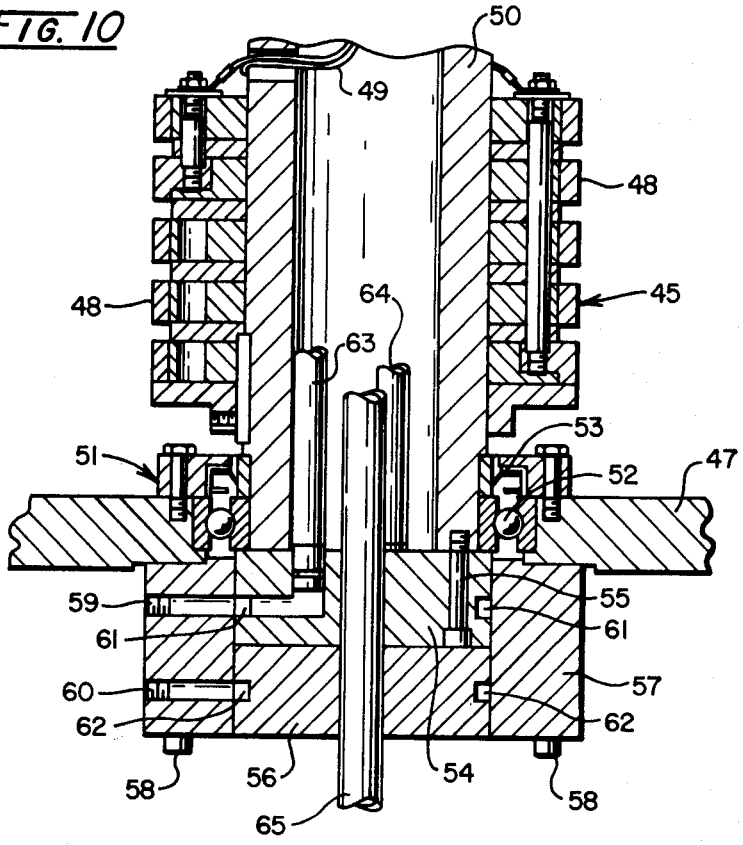
FIG. 10 is a similar view but taken at a different axial position.
Figure 11:
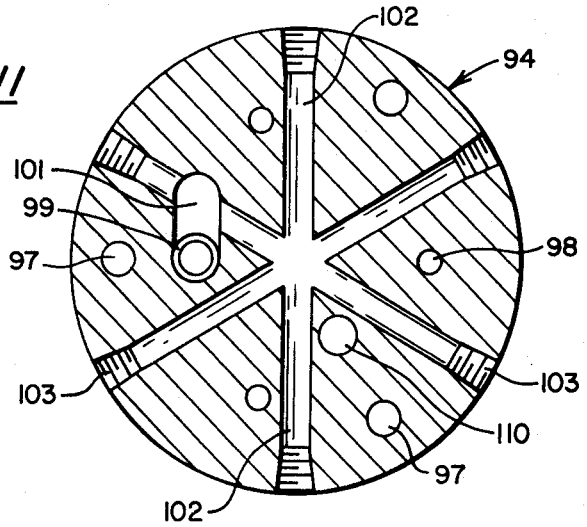
FIG. 11 is a horizontal sectional view taken along line 11—11 of FIG. 9.
Figure 14:
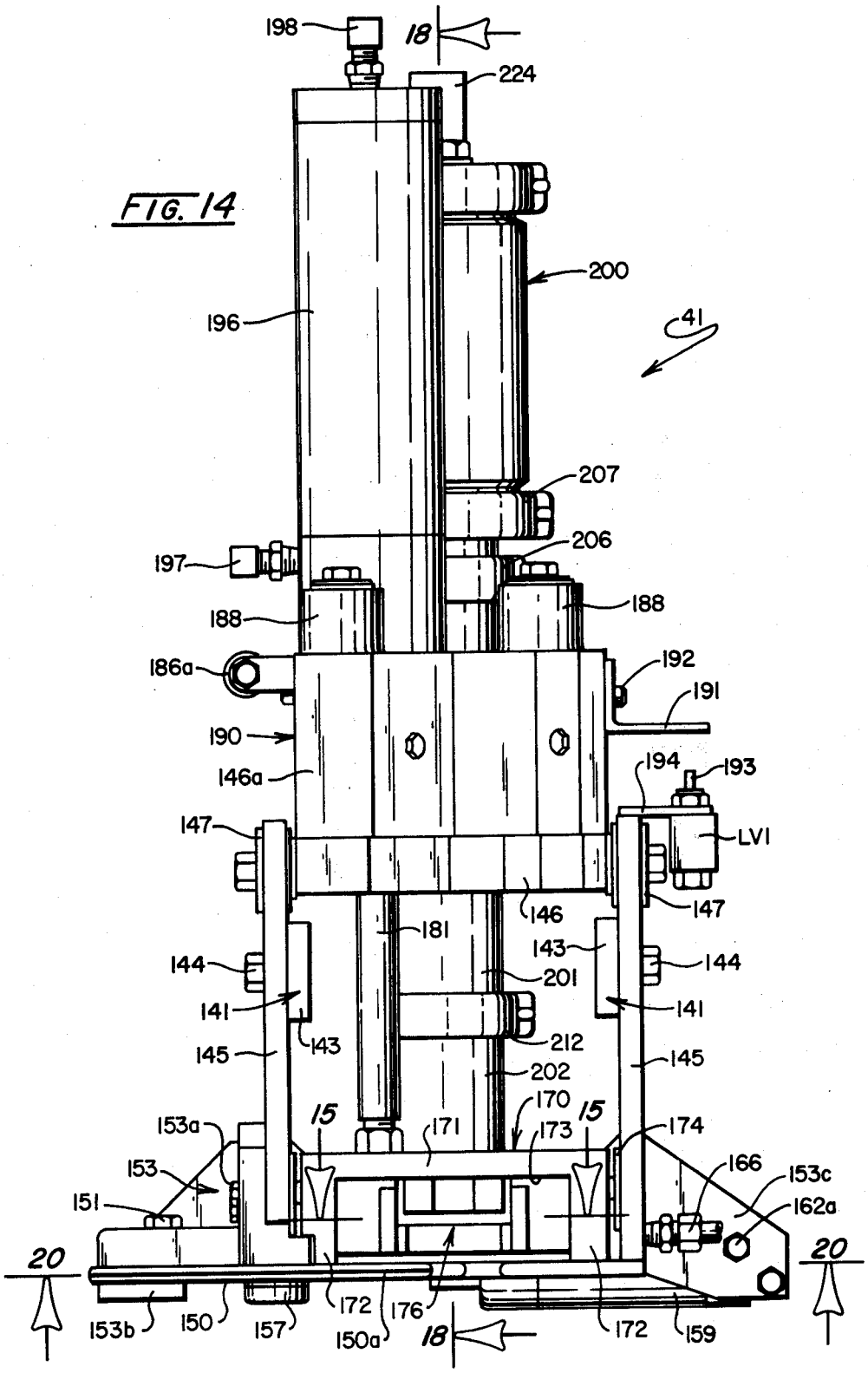
FIG. 14 is an enlarged front elevational view of one of the filler heads having movable uncapping and capping means.

The turret 40 is supported for rotation about its vertical axis by means of a base table 42 which supports an upstanding housing and support 43 that contains the main drive 44 for the turret 40 and a slip ring and brush assembly 45 for the electrical supply to the rotatable turret which is of a standard commercially available type. The brushes receive the current and supply it to the various rings 48 from which it is conducted up through the shaft 50 by wires 49 to various units to be actuated thereby. The brushes of this assembly 45 are carried by an upstanding arm 46 (FIG. 7) fixed to the base bearing support plate 47 of the housing 43 which does not rotate but the slip rings 48 thereof are carried for rotation with the upright main support shaft 50 for the thrust. The rings 48 are keyed to the main shaft which is mounted for rotation at its lower end in a bearing 51 (FIG. 10). The shaft 50 is hollow and the bearing 51 includes a ball-bearing 52 and a seal 53 which surround the reduced lower end of the shaft. At the lower end of the shaft, is a manifold collector which includes a collector disc 54, secured to the end of the shaft by bolts 55, and a disc 56 below it in face contact therewith and secured to the shaft similarly by a bolt passing through both discs and into the end of the shaft. Surrounding the superimposed discs 54 and 56 is a manifold ring 57 which is secured to the underside of plate 47 by upwardly inserted bolts 58. This ring 57 has a connection 59 for a vacuum supply line and a connection 60 for a nitrogen supply line. Vacuum connection 59 communicates with a groove 61 in the periphery of disc 54 and nitrogen connection 60 communicates with a similar groove 62 in the disc 56. Groove 61 communicates with vacuum line 63 which extends upwardly through the hollow shaft 50 and similarly groove 62 communicates with line 64 which may be a nitrogen supply line and which extends upwardly through the shaft. A main air line 65 extends upwardly through both discs 56 and 54 into the shaft. It will be apparent that discs 56 and 54 will rotate with the shaft 50 relative to fixed ring 57 but the fluid connections will be maintained.

The main drive 44 serves to drive the turret 40 in a counterclockwise direction and comprises an electric drive motor 71 (FIG. 8) and a reducer 72 which are supported by an upstanding support 73 that is mounted on the base plate 47 of the housing 43 by bolt and slot connections 74 for adjustment towards and from the axis of shaft 50. The reducer 72 drives a chain drive 75 to a large drive gear 76 which is keyed to the shaft 50 just below the upper bearing support of the housing 43.

The upper end of the shaft 50 is supported by a bearing arrangement 80 (FIG. 9) which is carried by a bearing support disc-like table 81 that, in turn, is supported by a flanged ring 82 bolted to and supported by the upper plate 77 of the housing 43. The bearing 80 includes the roller type thrust bearing 83 carried by a central opening in the disc 81 and a seal 84. The roller bearing and the seal surround a reduced upper end of the hollow shaft 50 and are enclosed by a retainer collar 86 bolted to disc 81 by bolts 85. A flanged table support collar 87 is bolted by bolts 88 to the upper end of shaft 50. This collar 87 supports the main support table 90 of the turret 40 which is in the form of a large horizontally disposed hexagonal plate. At its center, this table or plate supports a manifold and electrical supply distributing assembly 91 having superimposed discs consisting of the lowermost air-distributing manifold disc 92, the nitrogen-distributing manifold disc 93, the vacuum distributing manifold disc 94 and the electric wire distributor box or housing 95 which is closed by removable coverplate 96. Discs 92, 93 and 94 are fastened in superimposed relationship to hexagonal plate or table 90 at the center thereof by bolts 97 whereas box 95 is fastened to uppermost disc 94 by bolts 98. Box 95 has radial openings **95*a* through which the wires 49 pass to the various controls for the heads 41. Vacuum manifold disc 94 (FIG. 11) receives a fitting 99 which runs from the upper end of the vacuum line 63 in the shaft 50, through all the discs to a passage 101 communicating with all the diametrical bores 102 in the disc which provide, in the exaple, six fitting-receiving sockets 103 for connection to six vacuum lines running to vacuum supplies for the six filler heads 41 provided on the turret 40. Similarly nitrogen manifold disc 93 (FIG. 12) is provided with a passage 104 which connects to all the bores 105 having fitting-receiving sockets 106 at their outer ends. Passage 104 receives the supply of nitrogen from a fitting 107 which runs from the upper end of supply line 64 in the shaft 50, through the lower disc 92 and into the next upper disc 93. The air manifold disc 92 is supplied directly from the upper end of the tube 62 which communicates (FIG. 13) with six bores 108 extending radially therefrom and having fitting-receiving sockets 109 at their outer ends. Each disc has the vertical bore 110 and the bores 110 of the discs align for passsage of the wires 49. Thus, it will be apparent that the assembly 91 rotates with the table 90 which is supported by and rotates with the shaft 50. Consequently, the electrical and fluid connections to the turret 40 will be maintained during its continuous rotation. As indicated, wires or cables 49 take the electric current to various controls for the heads 41 and various small flexible tubes 49*a* (FIG. 4) connect to the various manifold discs 92, 93, 94 to provide the air, nitrogen and vacuum to the various heads 41 but these connections are made through control systems which are provided in control boxes 111, each one of which contains the controls for two heads 41**.

The hexagonal table or plate 90 of the rotatable turret 40 not only supports the heads 41 at angularly spaced radially-extending positions but also supports the drop tables 115, one of which is provided below each head for supporting a bag during the uncapping, filling and recapping operations as it is moved angularly with the continuously moving turret. Each drop table comprises a substantially square plate which is hinged at its inner edge to the adjacent edge of the hexagonal plate 90, as shown best in FIGS. 1 to 4. The hinging is by means of a hinge arrangement 116 (FIGS. 3 and 4) which permits controlled vertical swinging movement of the table 115 as the turret 40 rotates and this swinging movement is controlled by a cam arrangement. The table tends to drop by gravity about the axis of hinge 116 and to control this tendency, each table is equipped with a yoke arm 117 which is fixed to the lower surface thereof, at a point spaced from the hinge axis, and which extends at an angle thereto. This arm has at its end a yoke 118 carrying a cam following roller which is adapted to engage a cam track 120. This cam track is in the form of a rod which extends completely around the housing 43 and is supported thereby at its upper side 77. The support is by means of brackets 121 of different lengths and shapes so that the track 120 is gradually inclined in a predetermined manner so as to move the table between a radially extended horizontal bag-supporting position or a dependent bag-discharging position.

The hexagonal plate or table 90 carries a plurality of upstanding posts 125 at angularly spaced intervals which support a horizontal frame 126 at their upper ends. This horizontal frame supports a liquid supply tank 127 which will contain liquid to be supplied to the various filler heads for filling the bags B. The supply to the tank is through a main supply line 128 which enters at the center of the top wall. A float valve 130 is provided on the inner end of line 128 as a safety feature to shut-off the supply of liquid when it reaches a predetermined level in the tank. The tank 127 is provided with six outlets in its bottom which are connected by lines 131 to the respective filler heads 41. These lines include sections **131*a*** connected to the tank and flexible sections 131*b* connected to the filler heads as well as rigid intermediate vertical sections supported by a horizontal frame 132 carried intermediate the height of the posts 125.

Figure 5:
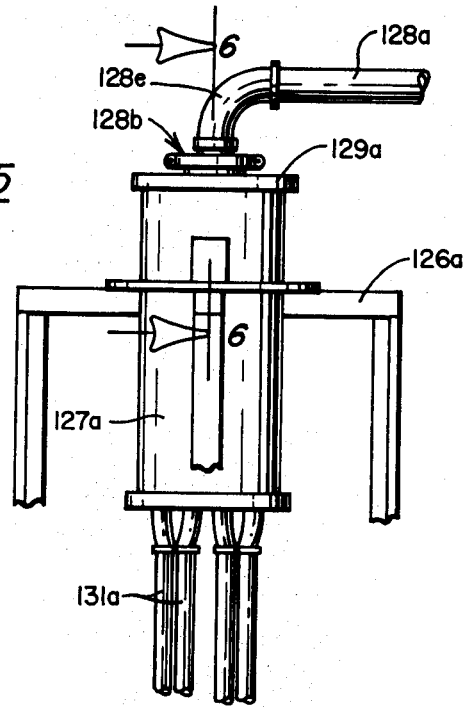
FIG. 5 is an elevational view showing a pressure supply connection to the turret.
Figure 6:
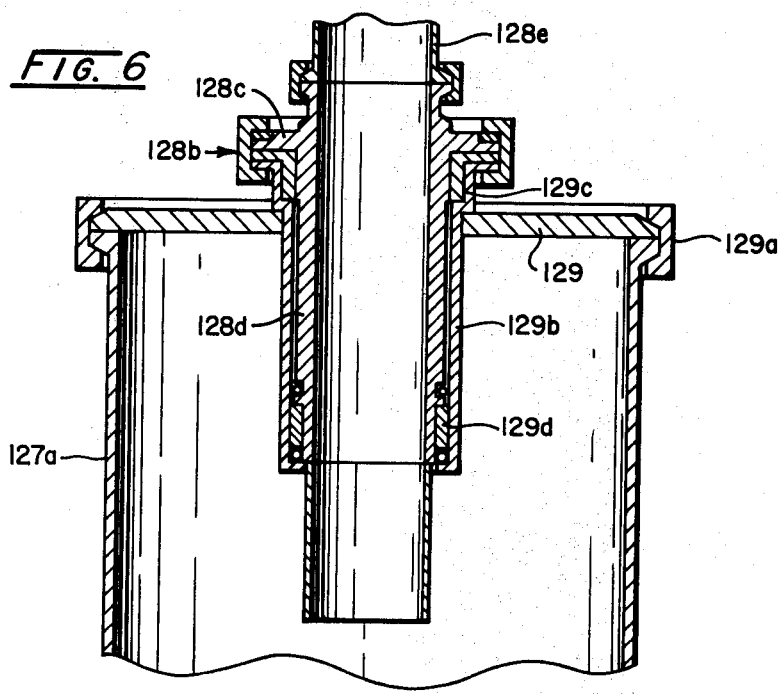
FIG. 6 is an enlarged vertical sectional view taken on line 6—6 of FIG. 5.
Figure 7:
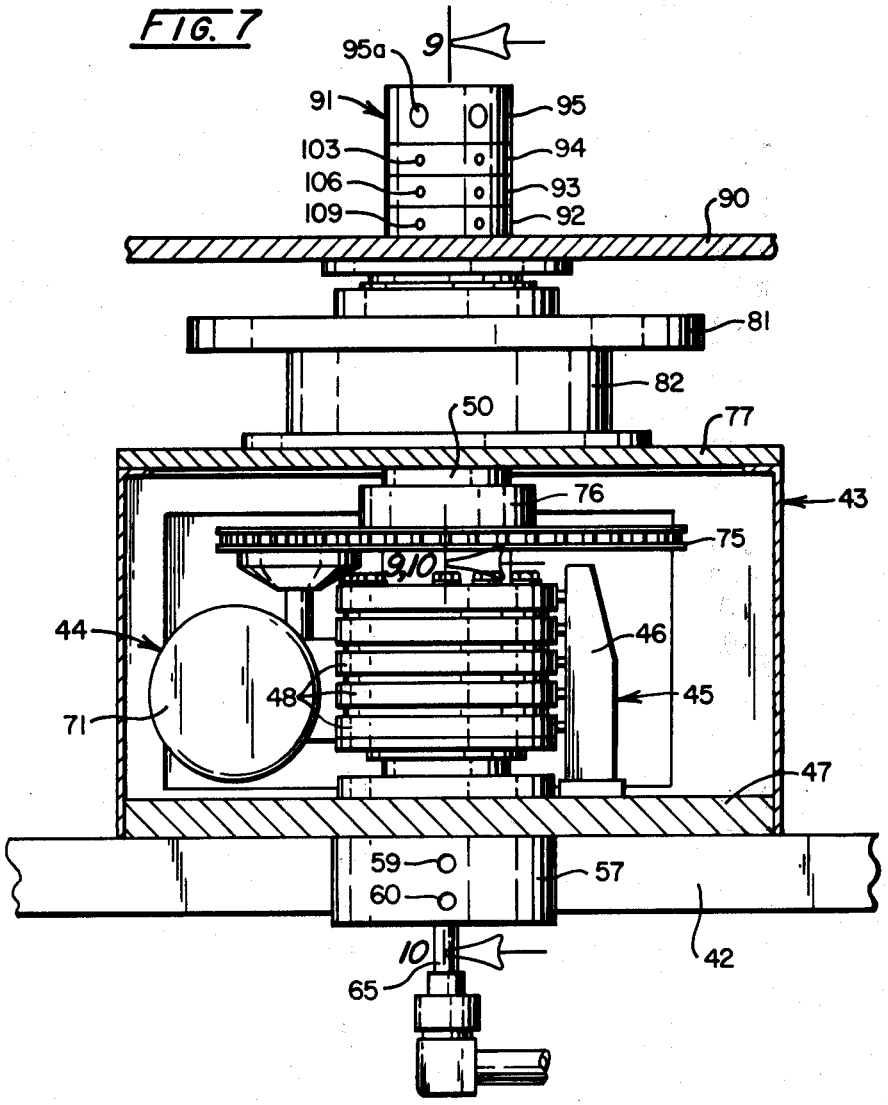
FIG. 7 is an enlarged vertical sectional view taken along line 7—7 of FIG. 3, showing the drive, manifold, slip ring and rotary brush assemblies.
Figure 8:
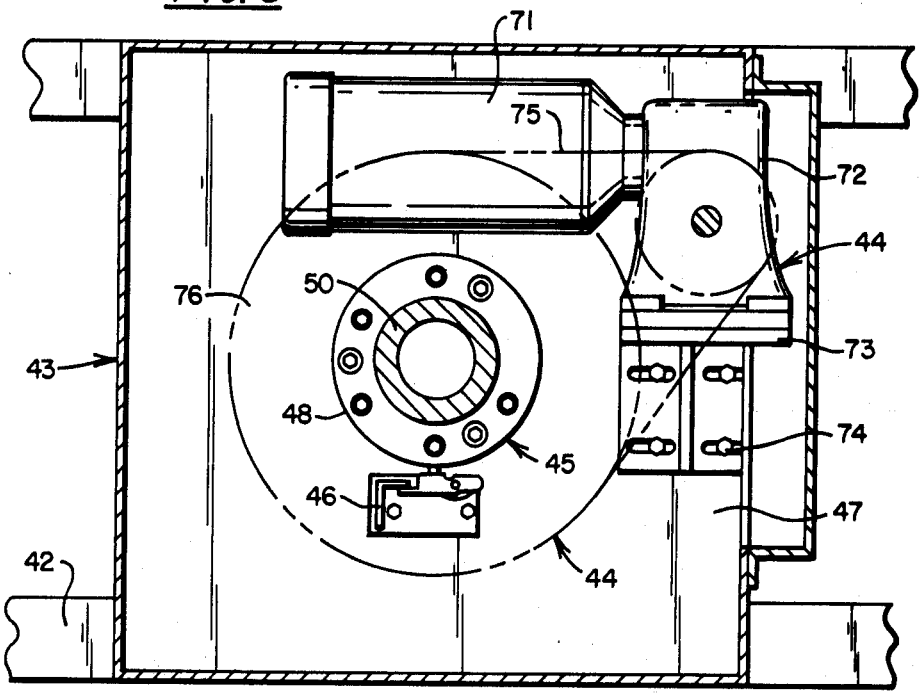
FIG. 8 is an enlarged horizontal sectional view taken along line 8—8 of FIG. 3.
Figure 12:
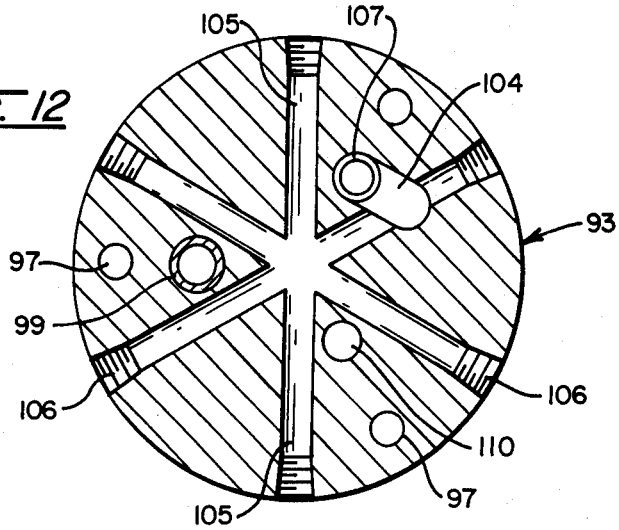
FIG. 12 is a horizontal sectional view taken along line 12—12 of FIG. 9.
Figure 9:
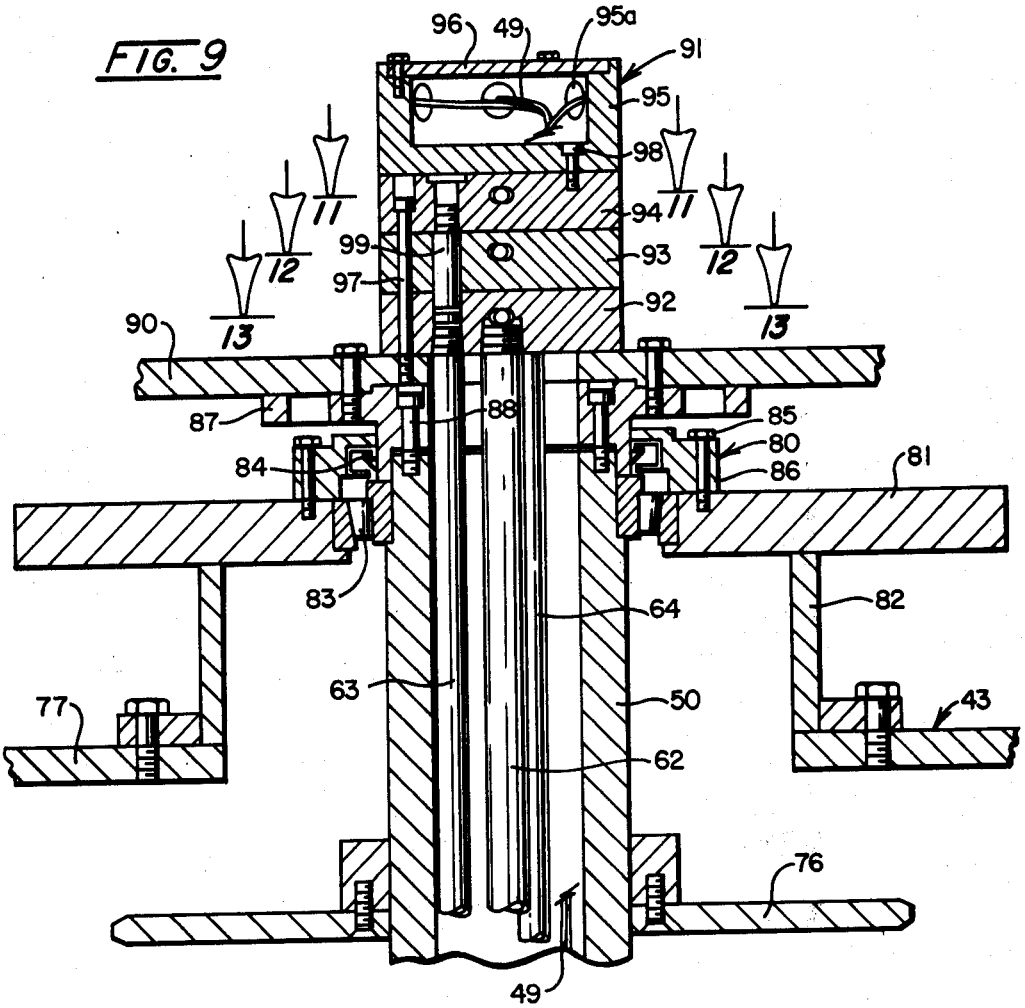
FIG. 9 is an enlarged vertical sectional view taken along line 9—9 of FIG. 7.
Figure 13:
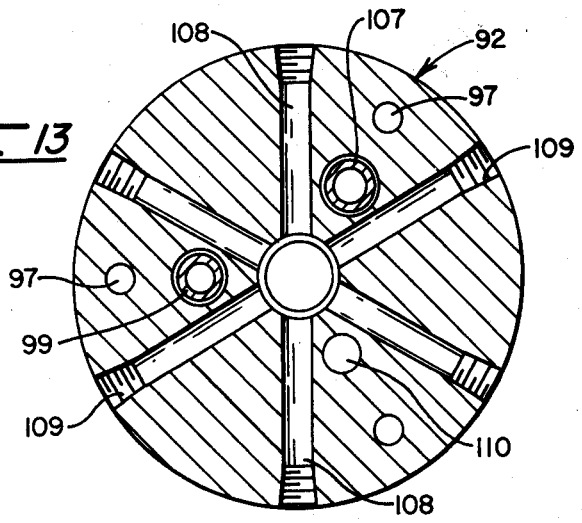
FIG. 13 is a horizontal sectional view taken along line 13—13 of FIG. 9.

Instead of filling the lines 131*a* by gravity from the tank 127 with the liquid or other subtance to fill the bags B, a pressure system, may be used, as shown in FIGS. 5 and 6 which includes a sanitary swivel joint that allows pressurizing of the system for flow rate control. This system includes stationary supply line 128*a* which will be connected by means including a swivel-coupling 128*b* to the lines 131*a* which lead to the various heads 41 on the turret 40, the connection also including the cylinder 127*a*. This cylinder 127*a* is supported at a suitable level on the turret 40 by the frame 126*a*. The upper end of this cylinder has a cap 129 removably mounted thereon by means of a removable retaining ring 129*a*. The cap 129 supports, in an opening at its center, a sleeve 129*b* which extends into the cylinder 127*a* and which has a flanged upper end 129*c* above the cap. Mounted within this sleeve 129*b* is a sleeve 128*d* which has a flanged upper end 128*c* adjacent the flange 129*c*. These flanges 128*c* and 129*c* are normally held in association with suitable seals and bearings by the removable coupling ring of the coupling 128*b*. The upper end of the sleeve 128*d* is connected to the line 128*a* by elbow 128*e*. The sleeve 128*d* is rotatably supported at its lower end by a bearing and O-ring seal 129*d* and extends on down into the cylinder 127*a* and normally fills the cylinder from the line 128*a* under pressure. The lines 131*a* are connected to the lower end of the cylinder and conduct the liquid or other substance from the cylinder under pressure to the various heads 41. As the turret 40 rotates, sleeve 129*b* will rotate on the sleeve 128*d*, which is connected to the stationary line 128*a*, thereby maintaining the pressure supply to the heads 41 during rotation. Thus, there is a swivel joint between stationary supply line 128*a* and lines 131 which revolve with the turret 40 but this joint can be readily disconnected for cleaning.

Figure 3:
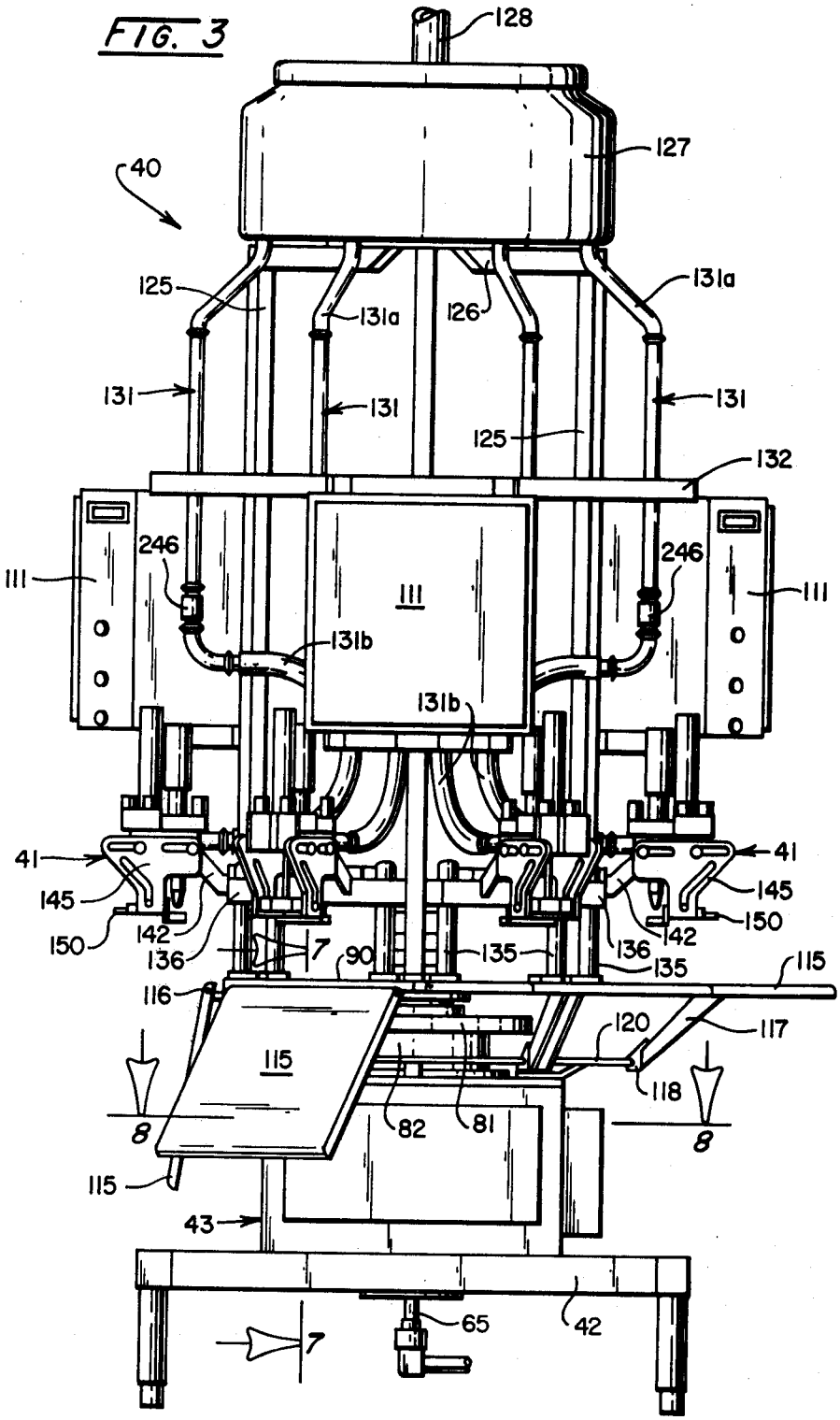
FIG. 3 is a side elevation view of the rotary machine.
Figure 4:
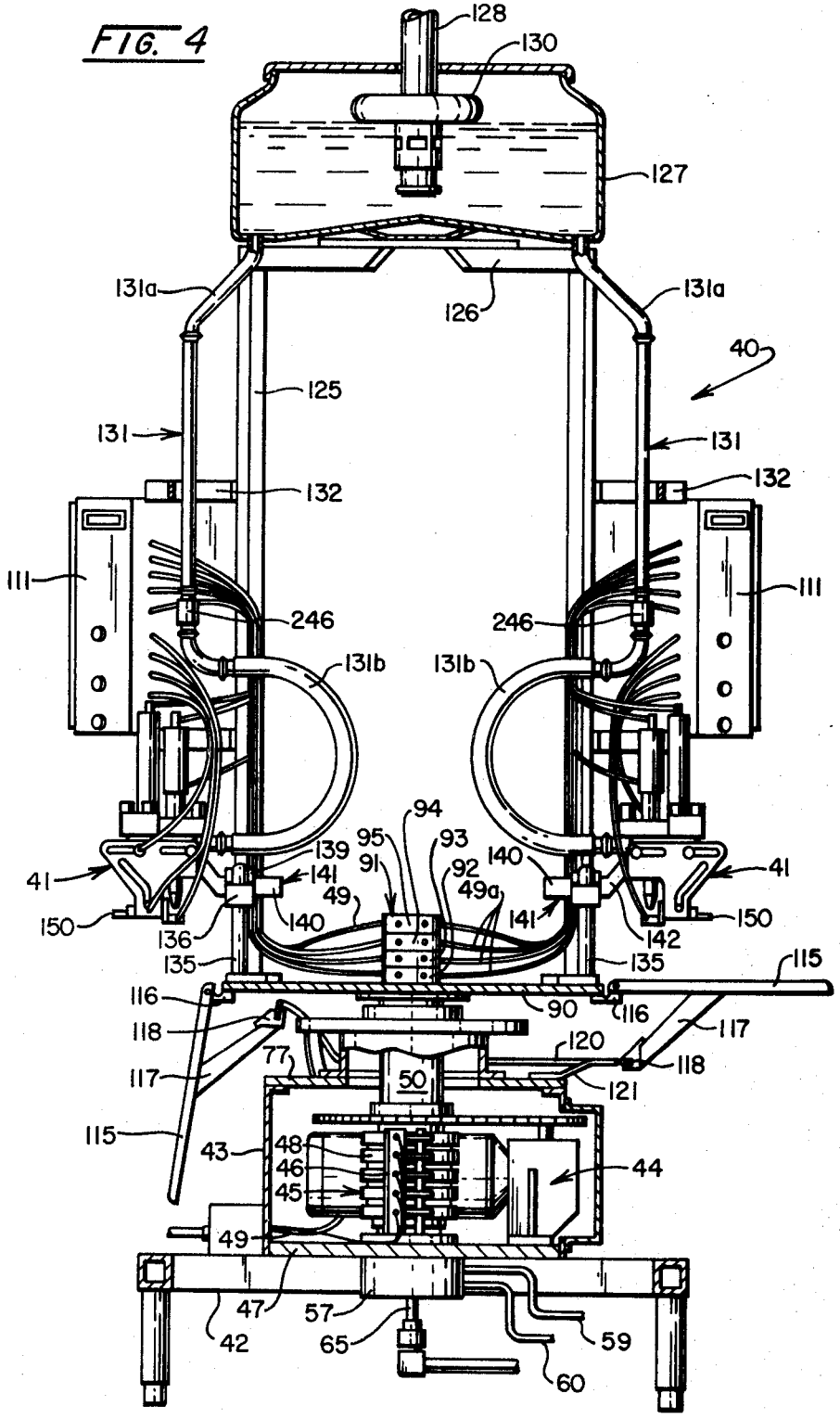
FIG. 4 is a vertical sectional view taken along line 4—4 of FIG. 2.
Figure 16:
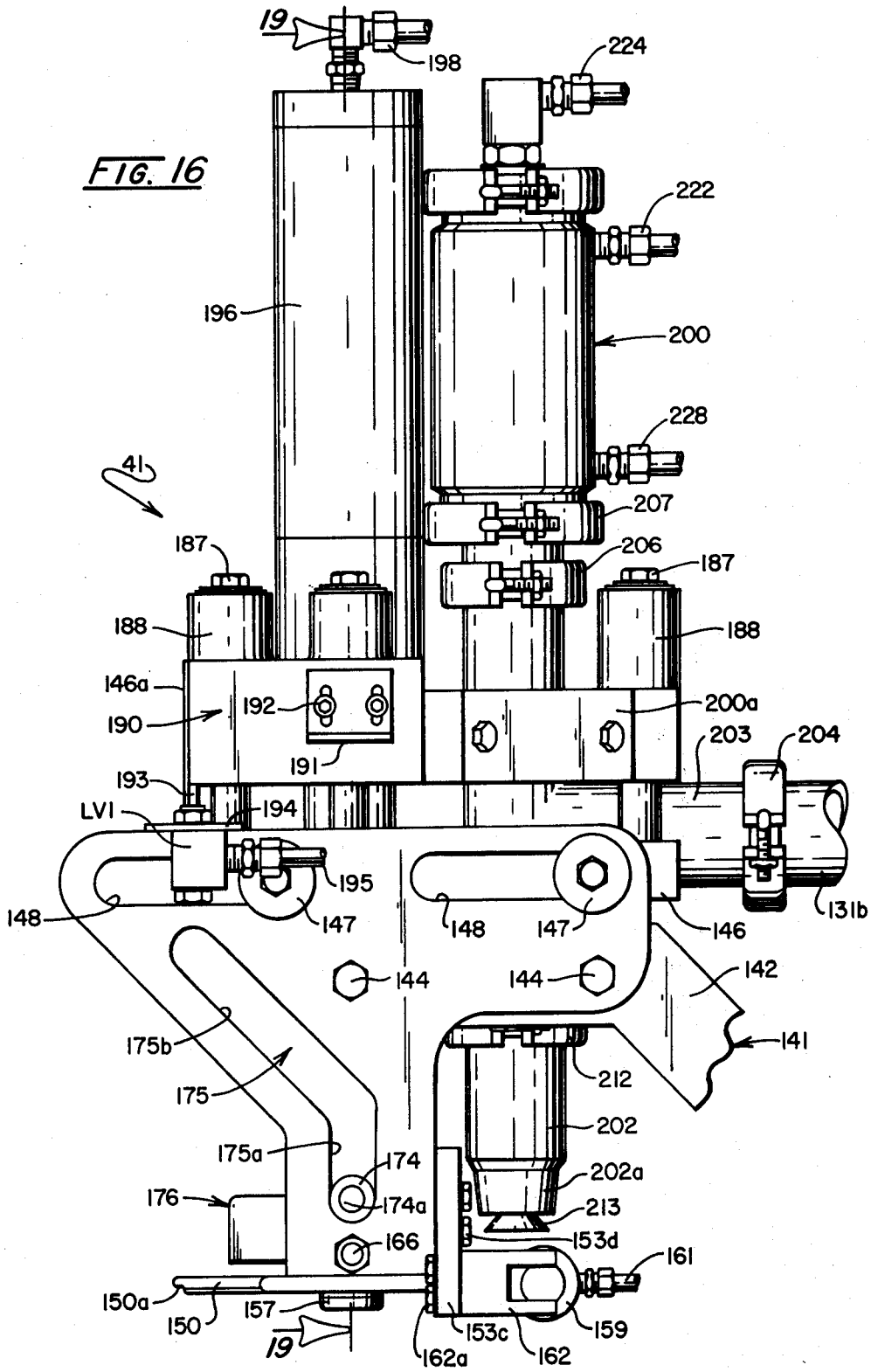
FIG. 16 is a side elevational view of the head.
Figure 17:
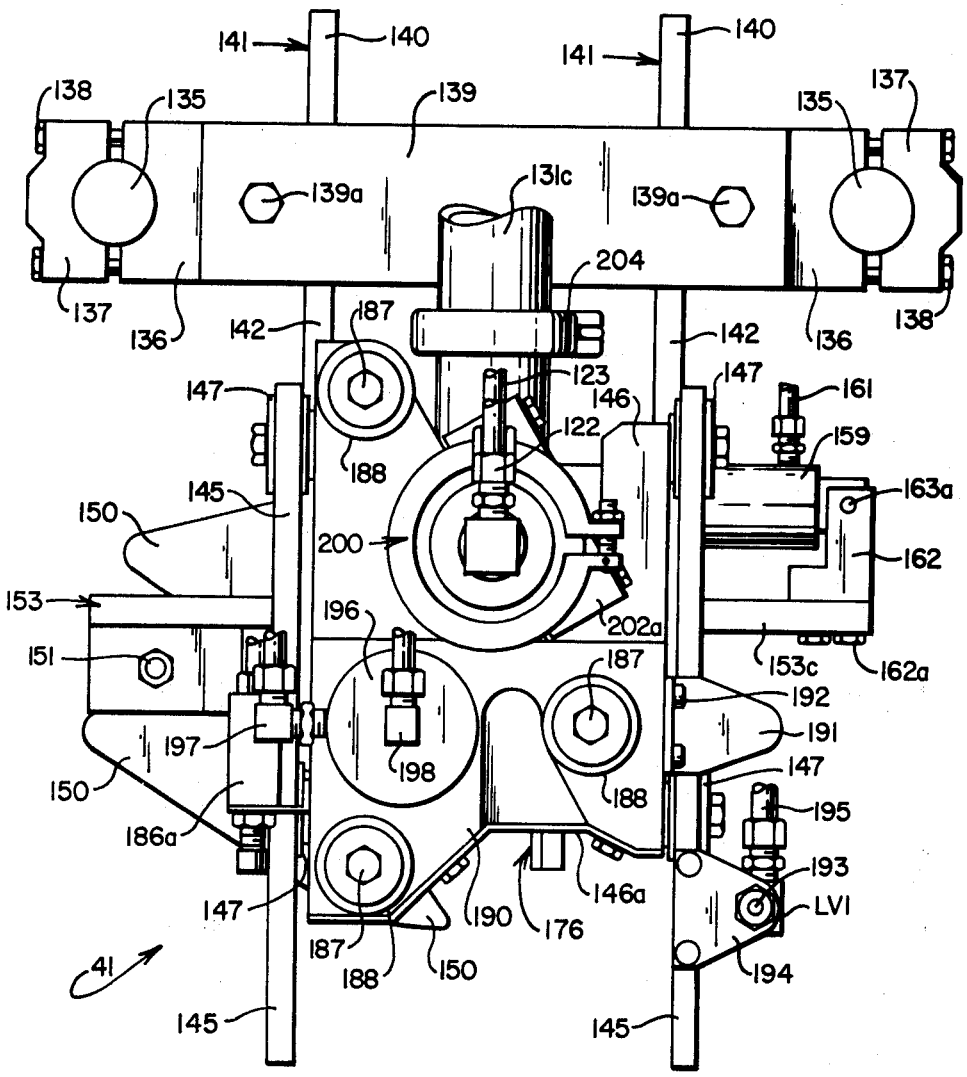
FIG. 17 is a plan view of the head.

Each of the uncapping, filling and capping heads 41 is supported at a pre-adjusted position on the hexagonal plate or table 90 for movement therewith. As indicated in FIGS. 3, 4, and 17 this support is by a pair of posts or standards 135 which are located at the adjacent straight outer edge of the plate or table 90, and are spaced equally from the midpoint thereof. This pair of posts supports a transverse support bar or beam 136 with caps 137 at each end which slip around the post and are adjustable to be clamped at different vertical positions thereon, being held in fixed position by clamping bolts 138. A second bar 139 is mounted on the beam 136, by clamping bolts 139*a* and is adapted to clamp the inner ends 140 of radially-extending a pair of flat head-support brackets or arms 141 on edge. These inner ends are horizontal and can be adjusted radially in and out relative to the axis of the turret 40. The brackets 141 have intermediate portions 142 extending upwardly and outwardly and an upper horizontal head-support portion 143 (FIG. 18) extending outwardly, for supporting one of the heads 41. The head 41 is illustrated best in FIGS. 14 to 19 and it will be apparent that with the radial adjustment provided by this bracket mounting, the head may be positioned in a predetermined accurate position outwardly over the position of the cooperating drop table 115 and, with the vertical adjustment provided, at a proper level relative thereto which will depend on the size of bags B.

Each pair of spaced support brackets 141 support a pair of radially-extending roller guide plates 145 which are part of the uncapping and capping means of the head. Each plate is disposed upright in flat contact with the upper horizontal support part 143 of the bracket 141 and is bolted thereto by bolts 144. The spaced upright plates 145 have disposed between their upper edges, for radial reciprocal movement, a main support carriage 146. This carriage at its opposite sides is supported by four rollers 147 (FIGS. 14 and 16) which operate in horizontal slots 148 formed adjacent the upper edges of the respective plates 145. Thus, the plates 145 are normally in fixed radial position whereas the carriage 146 is reciprocal radially relative to the plate or table 90. At its forward or outer end, the carriage 146 carries the upstanding guard plates 146*a*.

Figure 18:
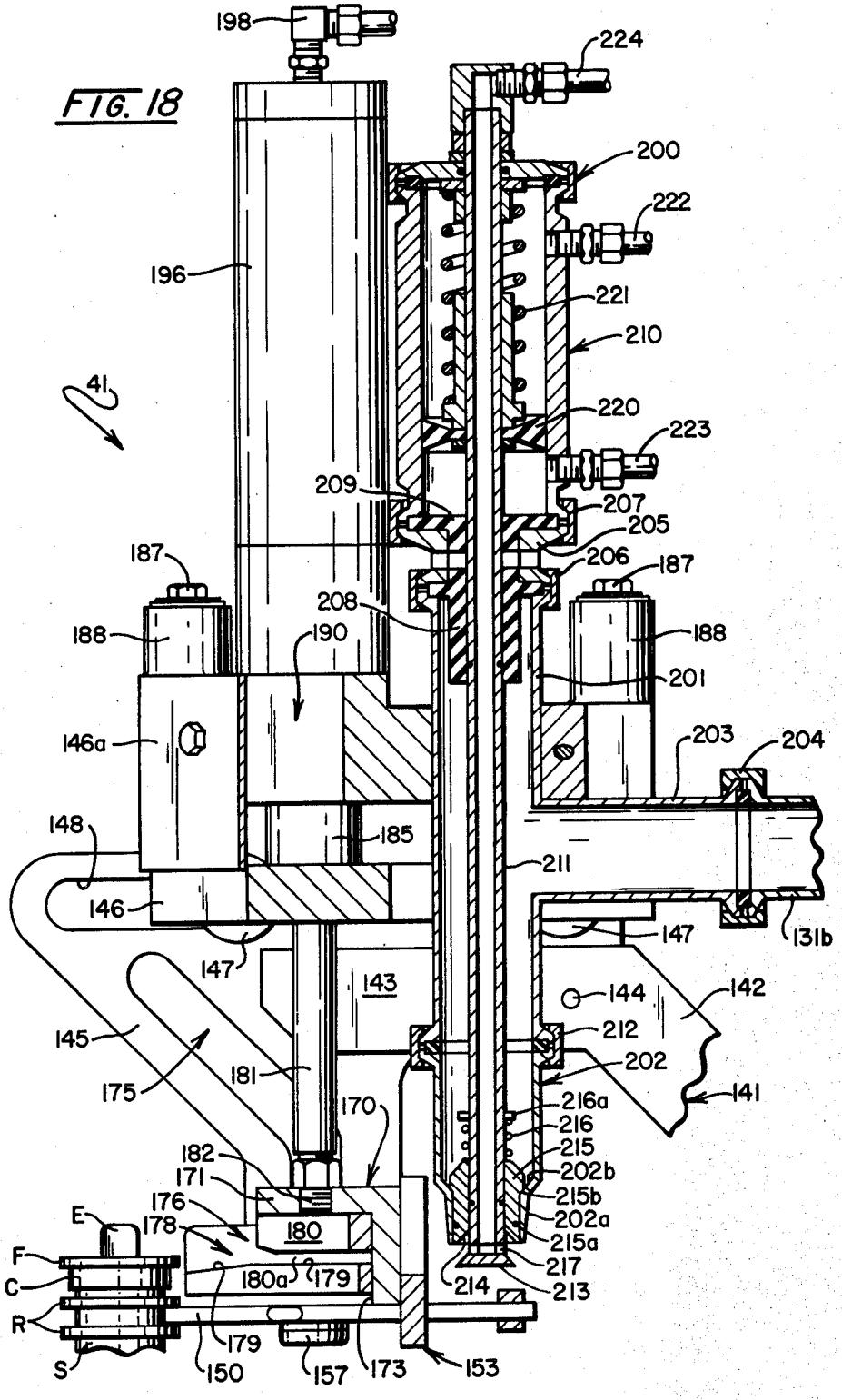
FIG. 18 is a vertical sectional view taken along line 18—18 of FIG. 14.
Figure 19:
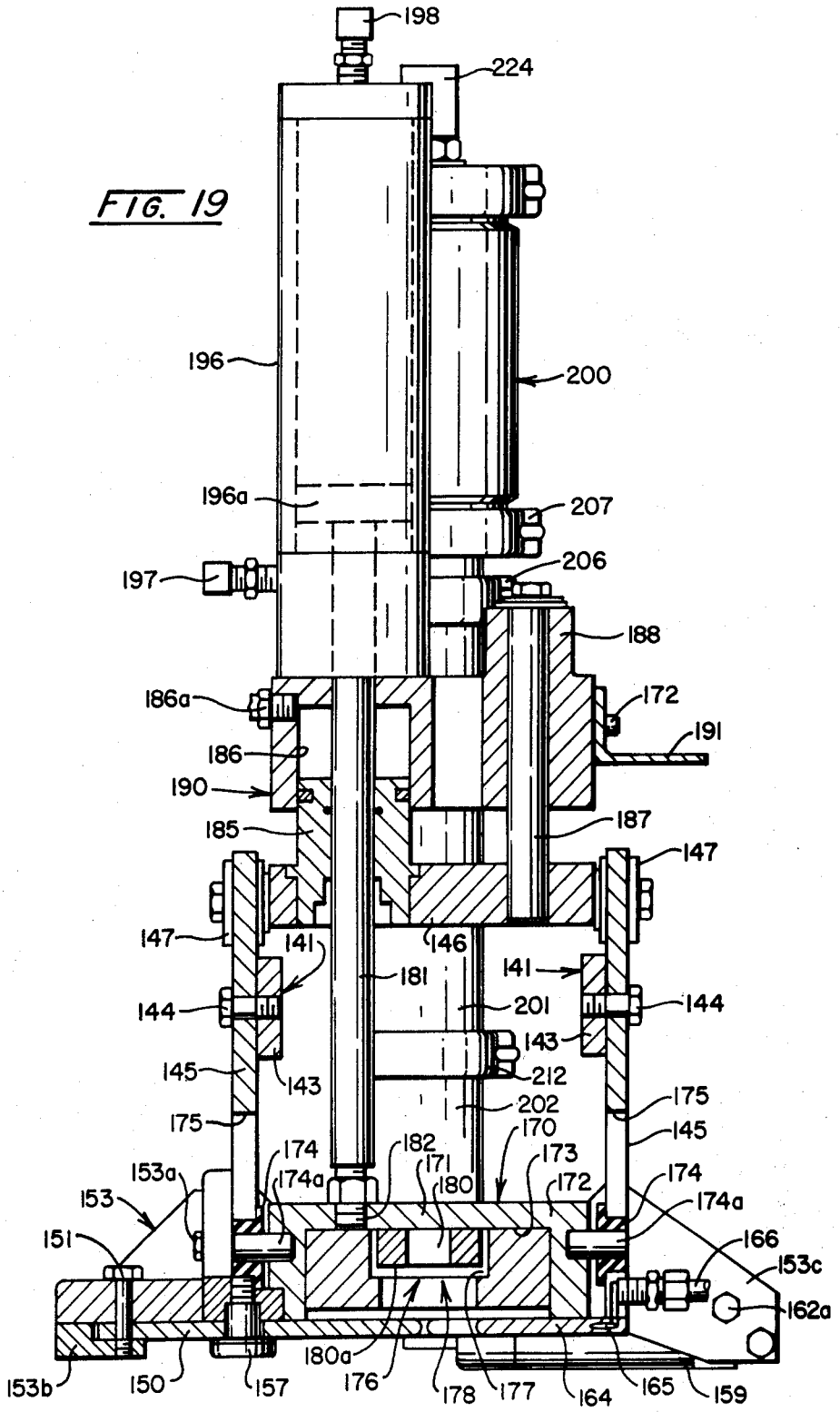
FIG. 19 is a vertical sectional view taken along line 19—19 of FIG. 16.

At the lower edge of one of the upstanding plates 145, a spoutengaging jaw plate 150 is mounted for oscillating movement. This plate 150 (FIG. 20) is pivoted at one edge to the adjacent plate 145 by a pivot 151 carried by one end of a bracket 153 bolted to plate 145 by bolts 153*a*. A stop lug on plate 150 engages an adjacent outwardly projecting stop portion 153*b* on bracket to determine the outermost pivoted position of the plate 150. At its opposite edge, the plate is provided with projecting jaws or guides 154 and 155 between which an outwardly spout-receiving notch 156 is provided. The bracket 153 also supports a depending pin 157 which cooperates with an arcuate slot 158 in supporting the oscillatable plate 150. The outer edge of plate 150 is recessed at 150*a* at its lower corner so that it will be thinner than the spacing of the flanges R on the spout S. For oscillating the plate, a pneumatic cylinder and piston unit 159 is provided and is controlled by air line connections 160 and 161. One end of the unit 159 is pivotally supported at 163*a* on the other end 153*c* of bracket 153 by a bracket 162 attached thereto by bolts 162*a* (FIGS. 16 and 17). This end 153*c* of bracket 153 is attached to the adjacent plate 145 by bolts 153*d*. The other end of unit 159 is pivotally connected to an adjacent corner of the plate 150 at 163. It will be noted, that the jaw 155 is short and the notch 156 forms part of a socket for receiving a spout S. The remainder of the socket is provided by a notch 156*b* associated with a convex protuberance 156*a* on a block 163 which has a spout-detecting air passage 165 therein connected to a line 166. The plate 150, in its initial position shown in FIG. 20, will be so located that it will engage and partially clamp the spout S presented thereto as the head approaches the loading position. The engagement of the spout will be at a level between the ribs or flanges R, axially spaced on the spout S (FIG. 18). As will later appear, when a spout S is partially inserted in the socket 156, the spout covers the outer end of the passage 165 and starts the operation of that filler head 41 so that the spout will then be completely clamped in position by the plate 150 as it is pivoted to its fully closed position by cylinder and piston unit 159. This will hold the spout S in a fixed position on the plate or table 90.

Mounted for vertical reciprocal movement on the carriage 146 and for combined horizontal and vertical movement relative to the relatively fixed guide plates 145, is the uncapping and capping means in the form of a cap-carrier 170. This cap-carrier 170 (FIGS. 14, 15, 18 and 19) includes a socket member which has a flat upper wall 171 with a depending retaining flange 172, which is omitted at one side to provide a radial notch 173 serving to permit entrance of a cap retainer 176. The flange 172 carries at diametrically opposite points, the axles 174*a* on which rollers 174 are mounted. These rollers operate in slots 175 in the guide plates 145, these slots being provided with lower inner vertical sections 175*a* and upper inclined sections 175*b* which extend upwardly and forwardly or outwardly (FIG. 16). The carrier 170, as indicated, is formed to receive a cap-receiver and retainer 176, which is designed to receive the particular type of cap C (FIG. 18) used on the spout S of bag B and which, in the example shown, includes a peripheral flange F and a top surface against which a pushing force can be applied, the cap in this example shown also having an upward extension E. The cap-receiver and retainer 176 is normally held in its receiving socket 173 in the carrier 170 by set screws 177 (FIG. 15) extending through depending flange 172 but is readily removable for replacement in case the filler head 41 is to be used with different sizes or designs of caps. The member 176 projects radially outwardly to provide U-shaped cap-receiving throat 178 (FIG. 15) for gradually engaging the sides of the cap and an inclined shoulder 179*a* for engaging a flange F on the cap to lift and guide it onto the horizontal shoulder of the receiving and retaining groove 179, at the same time the extension E moves into an upper receiving chamber 180. Thereafter, the cap thus can be lifted axially upwardly by the shoulder 179 engaging the flange F and moved axially downwardly by the wall 180*a* pressing down on the top surface of the cap. These axial movements of cap C will be accomplished by vertical movement of the carrier 170 and it will be understood that, at this time, the spout S will be held in a fixed axial position so that the cap C will be pulled off the spout S and later pushed back onto the spout.

The movement of the cap carrier 170 is accomplished by means of a piston rod 181 which has its lower end connected to the flat wall 171 thereof at 182. This piston rod is mounted for slidable vertical movement in a tubular piston and bearing member 185 which is fixed upright in the carriage 146 projecting upwardly therefrom. The projecting part of this piston slidably fits into a downwardly-opening cylinder 186 which is supplied with constant air pressure by a line 186*a* tending to move the piston 185 downwardly. The cylinder 186 is formed on the filler spout nozzle-supporting elevator 190, at one side thereof, this elevator being mounted for vertical reciprocal movement on the carriage 146 by means of a plurality of bearing pins 187 carried by an upstanding from the carriage 146 and slidably received within sleeves 188 formed on the elevator 190. It will be noted (FIG. 18) that the elevator 190 moves vertically relative to the forward guard 146*a* upstanding from carriage 146 and this guard prevents the entrance of objects therebetween. On one of its sides adjacent its outer or forward edge, the elevator 190 is provided with a valve-actuating arm 191 (FIGS. 14, 16, and 17) which is vertically adjustable thereon by a bolt and slot mounting 192. As will later appear, this arm 191 will, at certain times, engage the upstanding plunger 193 of a control valve LVI that is mounted on the side of the adjacent plate 145 at its upper and forward edge by a bracket 194. This valve is connected by air line 195 into the pneumatic control system, as will later appear. The piston rod 181 (FIG. 19) extends upwardly slidably through the top of cylinder 186 on the elevator 190 and its upper end is connected to the piston 196*a* of a pneumatic cylinder and piston unit 196 which is carried in a fixed upright position on the elevator 190. Movement of the piston 196*a* is controlled by the flexible air lines 197 and 198 connected to the lower and upper ends of the cylinder and piston unit 196.

As indicated, the elevator 190 carries the filler spout and nozzle unit 200 which is illustrated best in FIGS. 16 to 18. This unit comprises a vertically disposed lower spout or tube 201 and a valve-controlled nozzle extremity 202. The tube 201 has a radial inlet fitting 203 and is mounted in a fixed vertical position on the elevator 190 by a clamp 200*a* (FIGS. 16 and 17). The fitting 203 is coupled by a coupling 204 to the lower end of one of the flexible supply line sections 131*b* leading from the liquid supply tank 127, previously described. The upper projecting end of the tube 201 is connected to the lower end of a filler valve-actuating cylinder and piston unit 210 by a pair of couplings 206 and 207 and a metal tube 205 which positions and retains the tubular bearing and sealing members 208 and 209. This arrangement holds all these members in axial alignment to slidably receive the fluid passage tube 211 through which vacuum may be pulled and nitrogen gas supplied if desired.

The nozzle extremity 202 of the tube 201 is removably mounted on the lower depending end of the tube 201 by a coupling 212 (FIG. 18). The extreme lower end of the tube 211 carries a tapered valve member 213 which will seat on a seat 214 provided at the lower end of a tube guide and filler valve member 215 inserted in the lower end of the nozzle extremity 202.

A compression spring, 216, held in place by a snap ring 216*a*, surrounds the tube 211 and provides force between the tube 211 and guide and filler valve member 215. The guide and valve member 215 carries an O-ring 215*a* at its lower end that provides a seal with the lower inner wall 202*a* of the nozzle extremity 202. The guide and valve member 215 is stopped in the lower nozzle end 202*a* by a seal and stop ring 215*b* on the guide and valve member 215 engaging an annular seat portion 202*b* formed within the nozzle extremity 202. When the tube 211 is raised, the seat 214 of guide and valve member 215 receives and seats the valve 213, and seal 215*b* of the guide and valve member 215 is unseated from the annular seat 202*b* on the nozzle end 202*a*, thus allowing liquid to flow around the guide and valve member 215 and out through the nozzle 202 but preventing any fluid from flowing from the tube 211 and out of the nozzle. When the tube 211 is lowered, the flow of filling liquid from the nozzle 202 is halted by the seated guide and valve member 215 at 202*b*–215*b*, and the valve 213 is unseated from seat 214. Thus, the outlets 217, at the lower end of the tube 211, are exposed for application of vacuum and/or gas. Vertical movement of the tube 211 is controlled by a piston 220 connected to the upper end thereof and slidable in the cylinder of unit 210. A compression spring 221 normally biases the piston 220 downwardly but the movement of the piston is positively controlled by air pressure supplied by the flexible air lines 222 and 223. Another flexible line 224 connects to the upper end of the tube 211 at the top of the cylinder and piston unit 210 and may be used in the application of vacuum or gas.

As previously indicated, as the head 41 on the continuously moving turret approaches the the loading position, a capped spout S is presented to be clamped by the plate 150. It will be noted (FIG. 20) that at this time, the spout-receiving notch 156 is opened outwardly, with the protuberance 156*a* on fixed member 164 at one side of the mouth of the notch. The jaw 155 will extend outwardly over the curved section 156*b* on member 164 toward protuberance 156*a* so, in effect, a semicircular spout-receiving partial clamping socket 156 is formed. The control passage 165 detects the presence of the bag spout S and starts the operation of the filler head 41, as the turret 40 continues to rotate, including the operation of the clamp actuator 159 to swing the plate 150 inwardly to finally clamp the spout by jaw 154 swinging into engagement with protuberance 156*a* and jaw 155 moving out of the way so that there is a complete circular spout-clamping socket formed by notch 156 in cooperation with notch 156*b*.

The spout-receiving plate 150 is removable and replaceable to receive difference sizes or types of bag spouts. If a head 41 is not to be used, the control system for it is rendered inoperative with the plate 150 swung into closed position. The recessed edge 150*a* will project radially slightly but as it passes the next bag spout S being presented to the turret, it will merely pass through the space between the flanges R on the spout and will not engage it.

At the same time, the spout is moved into socket 156, the capreceiver and retainer 176 (FIGS. 18 and 21), on the capper and uncapper carriage 170 receives the cap C and causes it to finally be positioned with its peripheral flange or rib F in the retaining groove 179 thereof. The cylinder and piston unit 196 is then actuated to lift the cap carriage 170 which causes the rollers 174 (FIG. 16) thereof to follow first the vertical portions, 175*a* of the slots 175, in the guide plates 145, and then the inclined portions 175*b* thereof. The result is that the member 170 is first moved vertically to pull the cap C off the spout S and then laterally radially to move the cap to one side out of axial alignment with the spout S (FIG. 22). Cap carriage 170 will move until it strikes the main carriage 146 above. Cap-receiver and retainer 176 is replaceable for different caps. At the same time that the capper and uncapper carriage 170 is moved laterally, the main support carriage 146 is caused to move horizontally with the rollers 147 (FIG. 16) operating in the slots 148 of the plates 145. This causes the filler spout and nozzle unit 200 carried thereby to move laterally radially (FIG. 22) until nozzle 202 is axially aligned with the bag spout S, this nozzle movement being permitted by flexible line section 131*b*. The carriage 146 is stopped in this spout-aligning position by the engagement of carriages 170 and 146. The filler spout and nozzle unit 200 is, as indicated before, supported by the elevator 190 on the main carriage 145 normally in an uppermost position, due to pressure normally in the cylinder 186, which in effect provides an "air spring". This support will be at such a level that the lower end of nozzle 202 can move in axial alignment with the bag spout S, as the cap C is removed therefrom (FIG. 22). At this time, pressure is controlled in the cylinder and piston unit 196 to overcome the pressure in the "air spring" of the cylinder 186 and this will cause the elevator 190 to be forced downwardly on its guide pins 187 into contact with the carriage 146, at the same time actuating valve LVI by bracket 191 contacting plunger 193 (FIG. 16). This results in the tip of the nozzle 202 (FIG. 23) entering the upper end of the bag spout S ready for the filling operation. This operation will be accomplished by controlling pressure in cylinder 210 to operate the filler valves 213 and 215 (FIG. 18) and allowing a predetermined amount of liquid to flow therein and also applying vacuum and nitrogen through the line 224 and tube 211. To withdraw, the nozzle 202 after the closing of the valve 215, the pressure on piston 196*a* in cylinder 196 is controlled, allowing the pressure in cylinder 186 to raise the elevator 190 and the nozzle 202 out of the bag spout S. Then pressure is again applied on piston 196 under control of valve LVI, which is actuated by raising bracket 191 with the elevator, to move the piston rod 181 downwardly so as to move the capper and uncapper carriage 170, through are spring 186 without compressing it downwardly and laterally, which will first move the nozzle 202 laterally out of alignment with the bag spout S, during travel of rollers 174 down the inclined slot portions 175*b*, and then push the cap C onto the bag spout S, during travel of the rollers in the vertical slot portions 175*a*. The bag spout S will be released by the clamping plate 150 by actuating cylinder and piston unit 159. Plate 150 will be swung outwardly causing jaw 155 to engage the side of the spout and now eject it from the outwardly opening socket 156. This also causes the cap C to be pushed radially outwardly from the cap retainer 176. On the lower corners of the two control boxes 111 are valves LV2 for resetting the respective circuits therein to preclude a refilling cycle on a bag B on the respective head 41. These valves are cam-operated as will be explained later. Also, if the filled bag has not been ejected a switch SW2 is provided beyond the discharge station for engagement by the bag (FIG. 2) to break the circuit to the main drive motor 71. This, generally, is the manner in which the head 41 functions.

Figure 24:
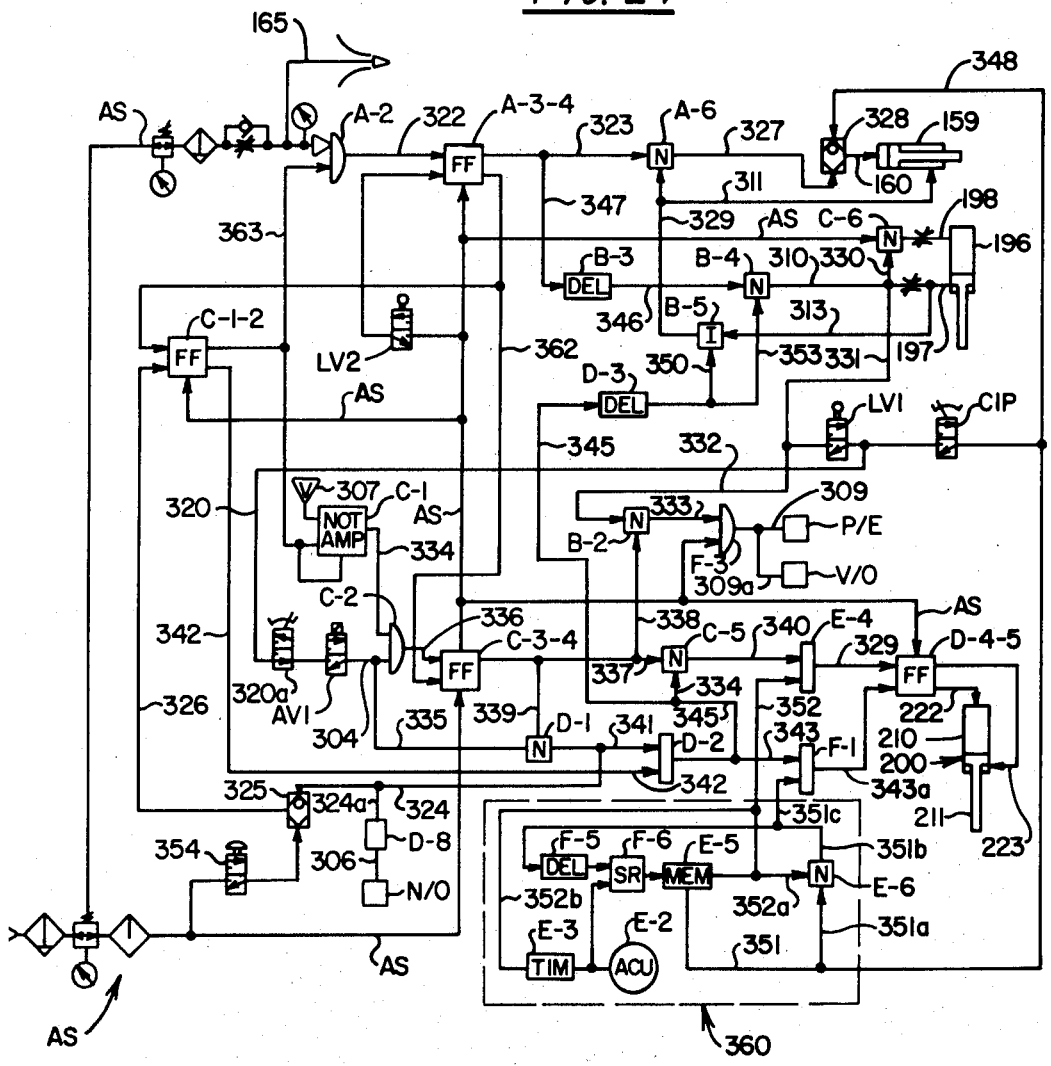
FIG. 24 is a diagram of the pneumatic control system of the machine.
Figure 25:
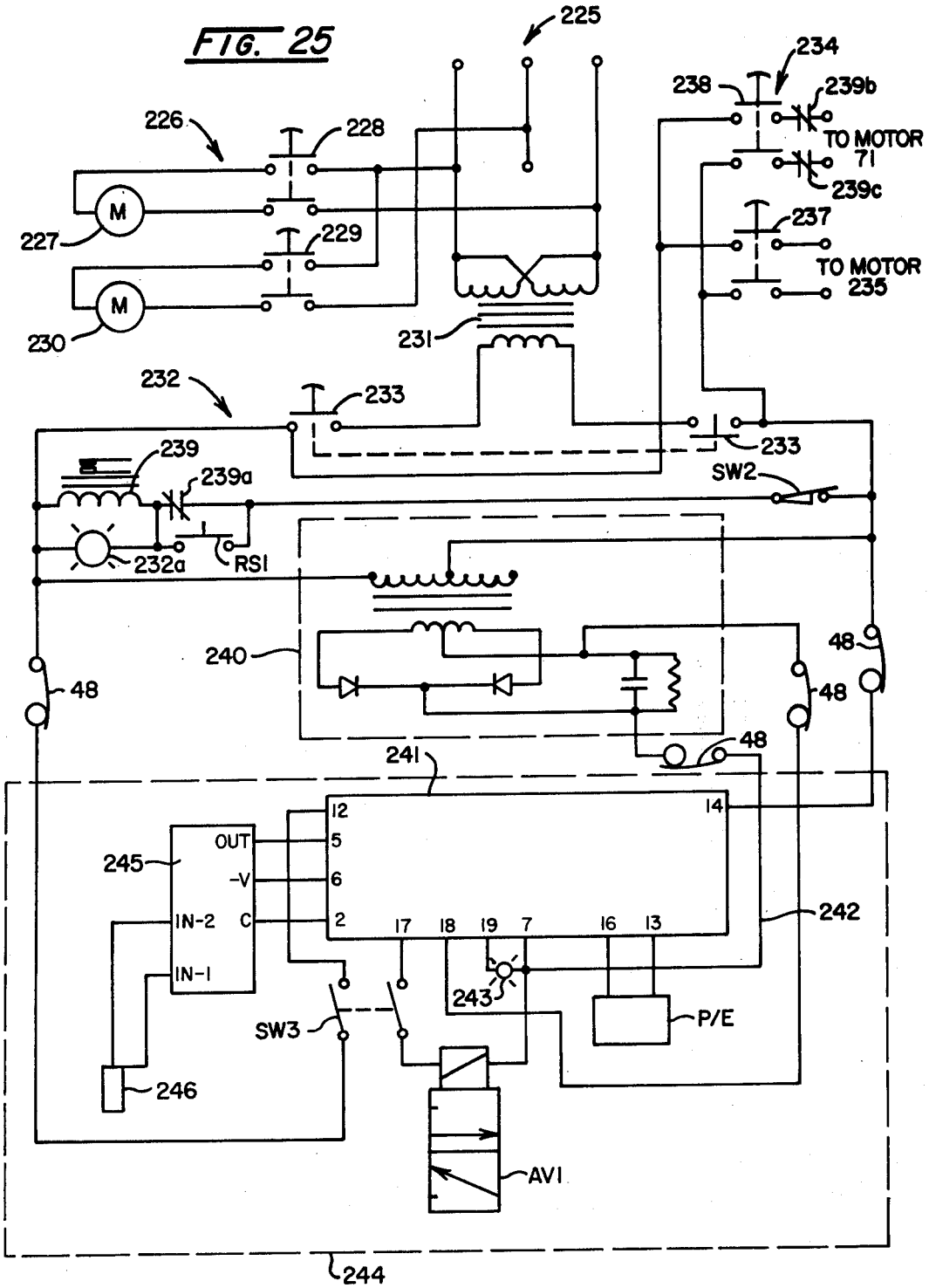
FIG. 25 is a diagram of the electrical system of the machine.

A pneumatic control circuit for controlling operation of the rotary filler machine in its entirety is shown in FIG. 24. An electrical circuit used in conjunction with the pneumatic circuit is shown in FIG. 25. This electrical circuit includes leads 225 from a suitable power source, a motor circuit 226 for motor 227 which will drive the vacuum pump, which connects to vacuum supply line 59 previously mentioned, and is under the control of double-pole switch 228. The leads also connect to a motor circuit, through double-pole 229, to a motor 230 which may drive a vacuum pump if an automatic bag feed is to be provided as will later be described. The leads also connect to a step-down transformer 231 to provide voltage for the main section 232 of the circuit on the machine, through a double-pole switch 233 that controls the supply of that voltage to the motor drive circuits 234 for the motors 235 and 71 under the control of the respective double-pole switches 237 and 238, respectively. A light 232*a* indicates when circuit section 232 is energized. Motor 71 was previously mentioned as the main drive motor for the turret 40. Motor 235 will be provided if an automatic bag feeder is used. Relay 239, having contacts 239*a*, 239*b* and 239*c*, is used for controlling drive motor 71 through bag-engaging switch SW2. Reset switch RS1 is used to reset relay 239 after switch SW2 opens it. Contact 239*a* of relay 239 holds relay 239 on set when switch SW2 is closed and reset switch RS1 has been set. Contacts 239*b* and 239*c* of relay 239 are held closed in the same manner as contact 239*a* allowing, motor 71 to run. The circuit section 232 includes a low voltage power supply 240 of a suitable type which supplies a voltage for the solenoid controlled valve AVI, controlled by a voltage flow counter 241, which can be of various commercially available types such as the Series-1000 COUNT/CONTROL manufactured by DURANT DIGITAL INSTRUMENTS. Current is carried through the slip rings 48 to the six filler heads 41 circuits, one being indicated generally by the numeral 244. One lead 242 of the power supply is connected to terminal 19 and a signal 243 indicates when valve AVI is energized, and other power leads are connected to terminals 12 and 14 for voltage flow counter 241. A pneumatic electrical switch P/E is connected to terminals 13 and 16 of counter 241. Switch SW3 controls power to valve AVI and counter 241 so that the filler head can be set in a standby condition for repair. The solenoid controlled valve AVI is connected to terminals 7 and 17 of the counter 241 as indicated. Connected to the counter 241 to provide an input signal thereto is the signal conditioner 245, having the outputs "Out", -V and C connected to the respective terminals 5, 6 and 2. The signal conditioner is also of a common type, one source being DURANT DIGITAL INSTRUMENTS. The signal conditioner 245 receives input at terminals IN-1 and IN-2 from a digitizing flow meter 246 of a common type which provides a signal in accordance with the volume of liquid flowing therethrough. The volume flow meter used may be of the turbine type, oscillating piston type, or electronic type. One type found very suitable is the turbine type known as "INVALCO" and manufactured by COMBUSTION ENGINEERING CORPORATION, of Tulsa, Okla. One of these flow meters 246 is interposed in each liquid supply line 131 (FIGS. 1, 3 and 4) which supplies liquid to the respective filler heads 41. Valve AVI and switch PE are part of the pneumatic circuit illustrated in FIG. 24.

This pneumatic system shown in FIG. 24 is primarily what is known as pneumatic logic and is essentially based on binary logic similar to that commonly used in computer and electronics. It can be explained in terms of conventional pneumatic valve functions. In describing it, the logic terms "and, or, not, flip-flop, etc." are used with conventional pneumatic logic and electrical switching symbols based on "USA STANDARD GRAPHIC SYMBOLS FOR FLUID POWER DIAGRAMS". A system like that indicated in FIG. 24 will be provided for each head 41. Systems for controlling two of the heads will be in each of the boxes 111 carried by frame 132 and posts 125 (FIG. 4).

A. Essentially, the complete uncapping, filling and recapping operation of each head 41 is controlled as follows:

The spout S of a bag B is inserted partially into the head 41.

The head as previously described will remove a cap C from the spout of an empty bag, move the fill nozzle tip 202 into the bag spout S, fill the bags, remove the nozzle from the bag spout, and reapply the cap.

B. The complete circuit of FIG. 24 funcations essentially as follows in controlling these operations:

1. The bag spout S is inserted part-way manually into the head 41.
2. As spout presence is sensed the spout is clamped by plate 150.

Spout sensor is air jet line 165 receiving air from supply as and is blocked by spout entering head 41, "and amp" A-2 is made producing output 322 which pilots "FF" ("flip-flop") A-3-4 (4 way valve) producing outputs 323 and 347 from air supply AS. 323 goes through "not" A-6 which produces output 327, and output line 160 through valve 328 which activates clamp/eject cylinder 159.

3. A short time interval allows full clamping by plate 150 and final positioning of the bag spout S before removal of cap C.

When FF A-3-4 was made output 347 was produced to "DEL" B-3, producing output 346 to "not" B-4 after a short delay by B-3 to allow the bag spouts to be fully clamped.

4. Cap C is raised from the bag spout S and simultaneously filler spout unit 200 moves horizontally towards the bag spout and nozzle 202 lowers into the spout.

"Not" B-4 makes outputs 310, 330, 313 and 331. Output 330 shuts off line 198 through "not" C-6, line 310 also activating the uncapping cylinder 196. Output 331 produced by "not" B-4 supplies air pressure to LVI previously mentioned. Output 332 is produced which makes "not" B-2, producing output 333 and "and" F-3, which produces output 309 which causes PE switch to reset counter 241 which activates solenoid-controlled valve AVI. Manual shut-off valve 320*a* is provided between AVI and LVI by output 320.

5. Vacuum is pulled on the bag B.

Output 309 makes valve V/O through line 309*a*. V/O supply valve connected to tube 212 opens vacuum to bag B.

6. Start of fill bag B.

No bag-nofill safety feature: Counter 241 must be reset, switch SW3 on, and vacuum detected in bag for fill to start if filler head is down in filling position, then LVI is made producing line 320. Resetting of counter 241 makes electric circuit to valve AVI, producing outputs 304 and 335, vacuum in bag creates a vacuum in line 307 which is sensed by "not amp" C-1 producing output 334, outputs 304 and 334 make "and" C-2 produces 336 setting "FF" C-3-4, supplied by AS, producing outputs 337, 338, 339, output 338 shuts off "not" B-2 stopping vacuum, output 337 makes "not" C-5 producing output 340. Output 340 makes "or" E-4, producing output in line 329 which sets Flip-Flop D-4-5 which makes output 223, to cylinder and piston unit 210, opening fill valve 215 and closing valve 213. Output in line 329 through Flip-Flop D-4-5 also closes line 222.

7. Liquid flow through the digitizing meter 246 feeds pulses to the counter 241. Filling is complete and the filler valve 215 closes when the pre-determined count is reached.

When fill is complete, AVI drops off and outputs 304 and 335 are lost. Loss of output 335 allows 339 to make "not" D-1 producing output 341 to "Or" E-4, and output 324 to Flip-Flop C-1-2 through valve 325 and output line 326. Output line 342 is made when Flip-Flop C-1-2 is set by output 326. Without output 342 the just-filled bag cannot be reclamped and refilled. Output 341 makes "or" D-2 producing outputs 343, 344, 345. Output 344 shuts off 340 through "not" C-5 which allows "FF" D-4-5 to reset with output 343 through "or" F-1 and output 343 shutting off line 223 and restoring air to 222 closing filler valve 215 and opening valve 213.

8. Immediately upon completion of fill, nitrogen is injected into the bag spout S simultaneous with closing of the valve 215 to liquids being filled. Nitrogen is injected through the hollow stem 211 and valve 213.

When "not" D-1 was made at end of fill, output 324*a* was also made, sending a pulse signal to D-8 and producing output 306 for short-timed nitrogen top-off to bag B through N/O supply valve connected to tube 212.

9. The same signal which closes the filler valve 215 and turns on nitrogen also activates the cylinder and piston unit 196, raising the filler nozzle 202 from the bag spout S. Mechanical motions combine to raise the filler spout and reapply the cap.

Output 345 produced by "or" D-2, at end of fill, makes "DEL" D-3 producing outputs 350 and 353. After delay by D-3 allowing fill valve to close before capping, line 353 shuts off output 310 through "not" B-4, loss of 310 restoring 198 through line 330 and "not" C-6 will return cylinder 196, removing filler spout and recapping.

10. Ejecting the capped spout S occurs after the cap is applied. Timing of eject operation is controlled by sensing the exhausting of air from the uncapper and capper cylinder line 313.

Output 313 holds "inhibitor" B-5. When cylinder 196 is completely exhausted "I" B-5 is made producing 329 and 311. Output 329 shuts off output 160 through "not" A-6 line 327 and valve 328 which allows line 311 to return piston in cylinder 159 and eject bag spout S. Activation of revolving reset valve LV2 supplied by AS produces output 361 which resets "FF" A-3-4 which produces output 362. Output 362 resets "FF's" C-1-2 and C-3-4 restoring supply to A-2 and C-1 through line 363. Rotating reset again assures that filled bag is not reclamped while waiting to be revolved from rotating turret 40. Resetting of "FF's" takes air off 311 of eject cylinder 159 so succeeding bag may be loaded.

11. Emergency stop.

Stop-Start valve 354, if actuated, will pilot "FF" C-1-2, through valve 325 and line 326, producing output 342 to "or" D-2, producing output 343, closing fill valve 215, and, line 345; causing capping, ejecting of spout S, and resetting circuit by means previously mentioned.

12. A clean in place and lock-out arrangement indicated generally at 360, can be selectively actuated when desired.

C.I.P. switched on produces outputs in lines 348, 351 and 351*a*. Line 351*a* supplies line 351*b* through "not" E-6 to "DEL" F-5, after a delay "SR" F-6 is made piloting "MEM" E-5, supplied by line 351, producing outputs 352, 352*a* and 352*b*. Output 352 will operate cylinder piston unit 210 to open fill valve 215. Output 352*a* will shut off air to F-5 through "not" E-6, at the same time making timer E-3 through output 352*b*, the timer E-3 in conjunction with accumulator E-2 will give up to 15 seconds delay keeping fill valve open. As accumulator E-2 is filled "SR" F-6 resets causing "not" E-6 to make output 351*c*, closing fill valve.

This gives a controllable oscillating of fill valve for CIP flushing.

Line 348 keeps spout clamp eject closed through valve 328 even if stop button 354 is activated. The reason for this is so bags cannot be loaded if CIP switch is on.

In the general operation of the machine, the turret 40 will be rotating continuously and the individual bags B with capped spouts S will be presented at the loading position either manually or automatically to the open clamping means 150 of the successive heads 41. At the loading position, the drop table 115 will be in horizontal position and, the bag B presented to the head 41, above the drop table 115, will be clamped partially and then in final position as the turret continues to rotate. The bag will be supported in a fixed position on the table 115 as the cap C is removed, vacuum is pulled, the bag is filled, and nitrogen is added, all these operations being performed during the continuous rotation of the turret, which results in high capacity operation. When the bag B is filled and the bag spout S is ejected, the table 115 that supports it, will immediately drop to discharge the filled bag onto a conveyor 350 (FIG. 2) which may be of any suitable type. Drop tables 115 are shown square but may be of other outline or size.

Valves LV2 previously mentioned, carried by the control boxes 111, revolve with the turret 40 and may be actuated by a cam plate 370 (FIGS. 1 and 2) which is suitably supported in a fixed position just beyond the spout-ejecting position to successively engage the valves as the turret rotates. Th bag-engaging switch SW2, previously mentioned, is carried on a suitable support 371 in a fixed position, adjacent the periphery of the revolving turret 40, so as to successively engage bags B not released from the filler heads 41, to break the circuit to the main drive motor 71 and stop rotation of the turret.

For some production installations, it may be desirable to provide an automatic bag separator and feeder for separating and feeding separate bags B to the filler machine turret 40. Such an installation is illustrated generally in FIGS. 1 and 2 and the automatic bag feeder itself, designated generally by the numeral 400, is shown in detail in FIGS. 26 to 31.

Figure 1:
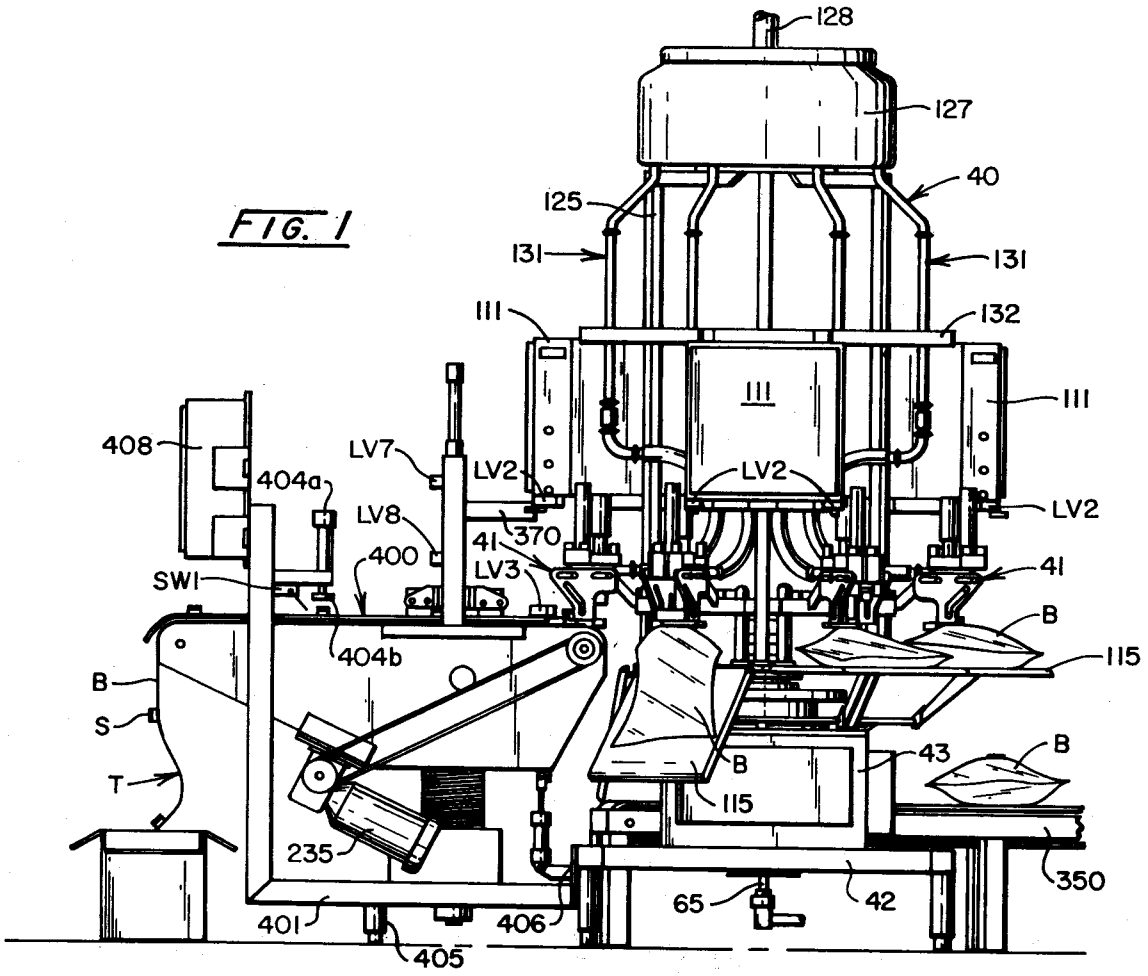
FIG. 1 is a side elevational view of a continuous rotary machine for uncaping, filling and recapping flexible bags having separable caps, embodying the principles of this invention, and indicating an automatic bag feed which could be used with it.

With reference to FIG. 1, the automatic bag feeder 400 is shown as comprising a base 401 which is disposed directly adjacent the base 42 of the filler machine turret at the loading position. The bag feeder may receive a strip of bags T from a carton and separate individual bags successively therefrom before feeding each separate bag into the clamping means 150 on successively presented continuously-moving heads 41 of the turret 40. The bag feeder 400 consists mainly of the vacuum gripping feed conveyor 402 and a vertically-disposed separator 403 mounted transversely of the conveyor intermediate its upper horizontal runs 402*a* and 402*b*. The strip T of bags B is provided with the usual transverse heat-sealed seams at longitudinal intervals and this is where the separation into individual bags by means of unit 403 occurs.

The base 401 rests on a leg 405 towards its front or outer side and is provided with a bumper 406 at its rear or inner side which will engage the adjacent side of the base 42 of the filler machine turret, as shown in FIG. 1. The base 401 carries at its front or outer side an upstanding frame 407 which has a box 408 mounted on its upper end that is adapted to hold the control system for this automatic bag feeder. The frame includes the upstanding laterally-spaced posts 409 (FIG. 27) having a transverse beam 410 intermediate the height thereof. The base 401 carries a high-exhaust fan or vacuum pump 411, and the vacuum drive motor 230 therefor is shown projecting from the lower side of the base. The motor 230 was previously mentioned in connection with the electric circuit of FIG. 25.

Also carried by a cross member supported by the posts 409 is a rearwardly-extending horizontal support arm 404 which is above and parallel to the upper run of the conveyor 402. The arm 404 has supported on its rear end an upstanding cylinder and piston unit 404*a*. This unit has on the lower end of its depending piston rod a removable and replaceable shoe 404*b* which is adapted to engage the cap C on each bag B as it is passed beneath the shoe that is located above the centerline of the conveyor. This unit 404*a* is actuated by the depending arm 404*c* of a switch SW1 which is located on the lower side of the support arm 404. The arm 404 is made of overlapping sections and is extensible and retractable longitudinally by means of a bolt and slot connection 404*d* to adjust for different size bags whereas the shoe 404*b* can be removed and replaced for different type caps.

The enclosure 413 comprises laterally-spaced longitudinally-extending upright side walls 418. These are joined by a bottom wall having a lower inner horizontal section 414 and an outer or front upwardly inclined section 415, joined to respective outer and inner sections 416 and 417. This enclosure thus provides a large chamber 420 from which air may be exhausted by pump 411, which is connected thereto by a large flexible conduit 421 with its upper end connected thereto at an opening in the wall 414 and with its lower end connected to the pump. The conveyor 402 will pass through the chamber 420 but the upper side of the chamber will be open so that at the horizontal or upper runs of the conveyor, vacuum will be applied thereto. This will be effective to cause the bags B to adhere thereto, since the conveyor 402 is in the form of a perforated continuous belt as indicated. Conveyor 402 is driven by reduction unit 412 attached to bottom section 415, which is driven by motor 235 previously mentioned in connection with FIG. 25.

For purpose of adjustment to the proper level for feeding into the heads 41 of the turret 40 or for quickly moving the adjacent end of the carriage 402 to or from that level, the enclosure 413 is provided at the rear end of and transversely midway of its bottom wall section 414, with a depending bracket 422. This bracket 422 is pivoted (FIG. 26) to the upper end of a pneumatic cylinder and piston unit 425 which, in turn, is pivoted to the bumper 406 on the base 401 by bracket 406*a*, midway transversely on the bumper. On bottom section 415 of the enclosure 413, a pair of laterally-spaced pivot brackets 426 are provided to pivotally mount the enclosure on the traverse beam 410 (FIG. 27) by means of pivots 427 carried thereby. Thus, actuation of cylinder and piston unit 425 will swing the enclosure 413 vertically about the pivot axis 427.

As indicated, the top side of the enclosure 413 is open, the upper run of the conveyor being divided into an outer longer run section 402*a*, supported by longer longitudinally-extending, laterally-spaced bars 428, and an inner shorter run section 402*b*, supported by shorter longitudinally-extening bars 429. All of these bars are carried by transverse rods 430 supported by the upright side walls 418. To form the inner shorter horizontal run section 402*b*, the belt passes over a large drum 431 and a smaller drum 432 (FIG. 29) and to form the outer longer section 402*a*, the belt passes around a large drum 433 and a smaller drum 434. The drums 432 and 434 are adjacent but spaced to permit the belt to pass downwardly around a lower drum 435. The one drum 433 is driven by a belt drive 436 from the reduction unit 412 driven by the motor 235. A standard pneumatically-actuated brake and clutch unit 438 (FIG. 28) is associated with the adjacent end of the drum 433 as part of this drive to provide for an intermittent drive. The drums supported in this manner provides a vertical, upwardly-opening gap 437 down into which the bag separator member 403*a* of the unit 403 may move as will be explained later.

The idler drum 431 and driven drum 433 at opposite ends of the plates 418 are carried by axles disposed therebetween and are maintained in fixed spaced relationship. The idler drums 432, 434 and 435 are supported for adjustment longitudinally of the plates 418 as a unit so that the gap 437, along with bag separator unit 403, can be adjusted in accordance with different length bags B to be separated from the strip T. For this purpose, the three drums 432, 434 and 435 are carried by a pair of upright plates 418*a* disposed just inside the upright plates 418, and being mounted for sliding movement within and relative to these plates. It will be noted that these plates 418*a* carry, by means of transverse rods 430*a*, bars 428*a* and 429*a*, which cooperate with and are slidable relative to the respective belt support bars 428 and 429. The plates 418*a* are supported by opposed bushings 440 (FIGS. 29 and 30) which are received in guide slots 441 extending longitudinally of each plate 418*a*. Each bushing 440 is threaded on a screw 442 which extends through a strip 443 fixed to plate 418*a*. The screw 442 may be rotated in strip 443 by knob 445, exteriorly of wall 418, to clamp the bushing 440 in any longitudinal position in the cooperating slot 441. This, the plates 418*a* may be adjusted longitudinally of the plates 418, and they will move as a unit because they are joined together by lower transversely extending bars 446 (FIG. 29) The belt of conveyor 402 may be tightened by means of a vertically adjustable take-up drum 447, which is carried by vertically adjustable slides 448 mounted in guides 449 attached to the inside surfaces of opposed plates 418*a*. These slides are adjusted vertically by screws 453 threaded there-through and engaging at their lower and upper ends, respectively, with slides 448 and mounting brackets 451 for the lower drum 435. These screws are adjusted through slots 414*a* in the horizontal wall 414.

The bag separator unit 403 comprises a yoke or inverted U-shaped frame 452 which is disposed traversely of the conveyor 402, upstanding therefrom, and in the same transverse plane as the gap 437. The frame 452 may carry the cam 370 previously mentioned (FIGS. 1 and 2) whereas support 371 for switch SW 2 may be carried on a horizontal part of feeder 400, such as strip 461*b*. A bag separator member 403*a* is mounted for vertical reciprocating movement on the upright frame 452. The lower ends of the vertically disposed sides 452*a* of the frame 452 are fixed to the movable side plates 418*a* so that the unit 403 will adjust longitudinal with the conveyor support drums 432 and 434 and the separator member 403*a* thereof wil always be in the alignment with the gap 437. It will be understood that the side members 452*a* will be outwardly beyond the side edges of the conveyor belt 402. It will be noted that side members 452*a* are in the form of inturned channels and carry inwardly-extending notched guide brackets 456 at vertically spaced intervals for guiding vertical movement of the separator member 403*a*. This separator (FIGS. 27 and 30) includes depending vertical rod guide portions 457 which carry a severing plate 458 having a pair of upstanding severing triangles 458 and 458*b* at its upper edge and similar depending triangular portions at its lower edge. These triangular portions 458*a* and 458*b* will engage the bag strip to separate the adjacent bags at the successive heat-sealed transverse seams, both on the downward and upward travel of the separator. The separator member 403*a* is supported for vertical reciprocation by means of a crosshead 459 which is carried by the lower end of the piston rod of a cylinder and piston unit 460 which is supported by the top member 452*b* of the frame 452. To provide guide channels for receiving the upstanding spouts S on the strip T of bags B, guide strips 461*a* and 416*b* are provided ahead of and behind the frame 452 and, therefore, the tranverse line of engagement of member 403*a* with the bag strip T. These strips are arranged in pairs of longitudinally extending, laterally spaced strips (FIG. 27) and it will be noted that the strips 461*a* are longer but disposed over the entire length of the conveyor section 402*a* and the strips 461*b* are shorter but disposed over the entire length of the conveyor section 420*b*. The two pairs are supported from side frame members 452 by the respective brackets 462*a* and 462*b* carried by two pairs of transverse rods 463*a* and 463*b*. The respective brackets 462*a* and 462*b* are adjustable transversely along the rods 463*a* and 463*b*, thus allowing for spouts S of bags B to be located at any point on the bag.

Strips 461*a* (FIG. 26) curve down over the outer end of the upper run section 402*a* of the conveyor at 461*c* whereas strips 461*b* terminate short of the end of the section 402*b* at 461*d*. The strips 461*a* and 461*b* can be interchanged with other length strips to accommodate different lengths of bags.

During downward movement of the separator 403*a*, its triangular lower portions 458*a* and 458*b* will pass downwardly through the bag strip T to separate a bag therefrom, engaging the bag strip C at two points intermediate its side edges and then gradually inwardly and outwardly from these points in both directions. Before upward movement of the separator, the bag strip will have been advanced through it, so the lower triangular portions 458*a* and 458*b* of the separator will subsequently pass upwardly through it to separate a bag therefrom, engaging it first at two points intermediate its side edges and then gradually inwardly and outwardly therefrom. Thus, distortion of the strip transversely will be prevented.

Figure 26:
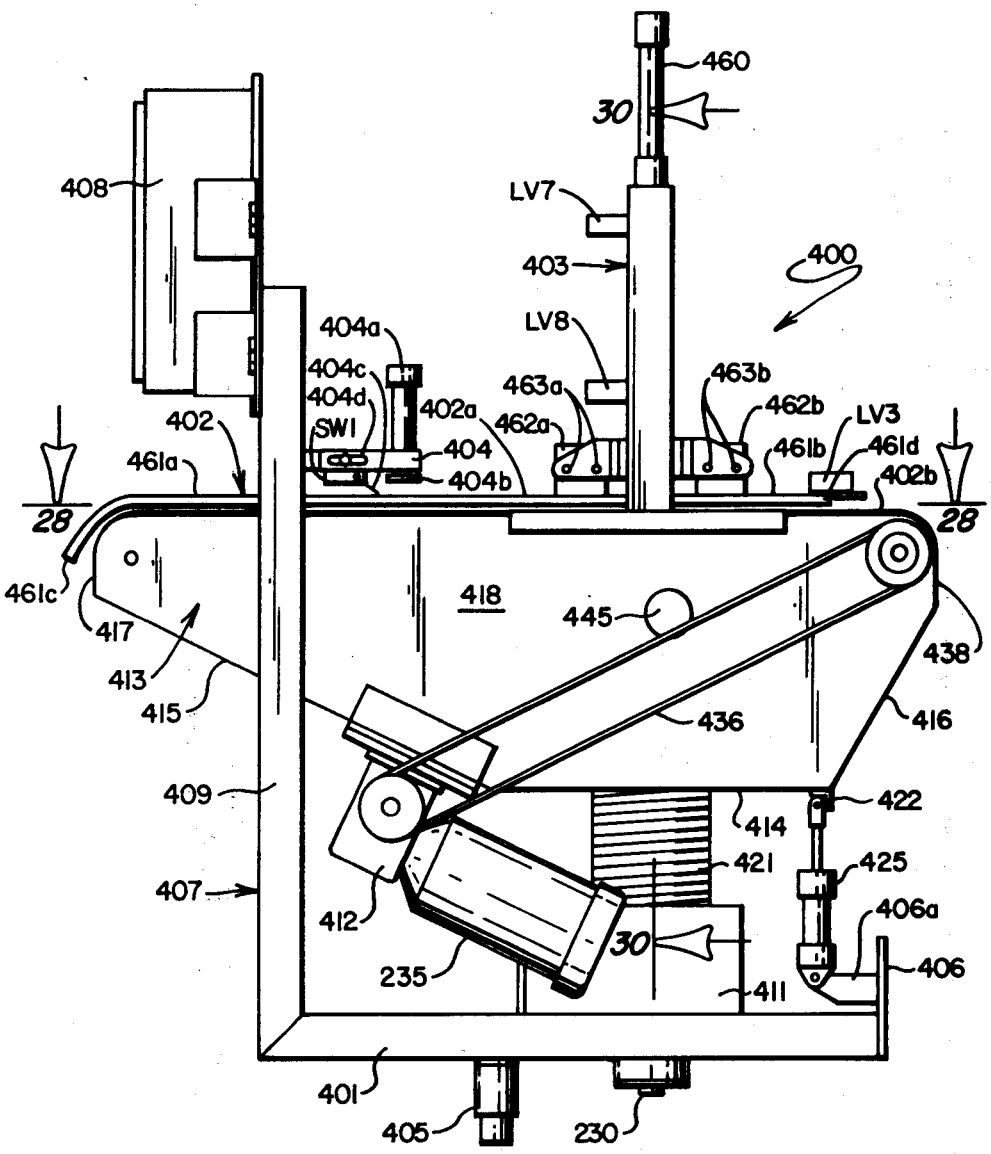
FIG. 26 is a side elevational view of the automatic bag filler of the machine.
Figure 27:
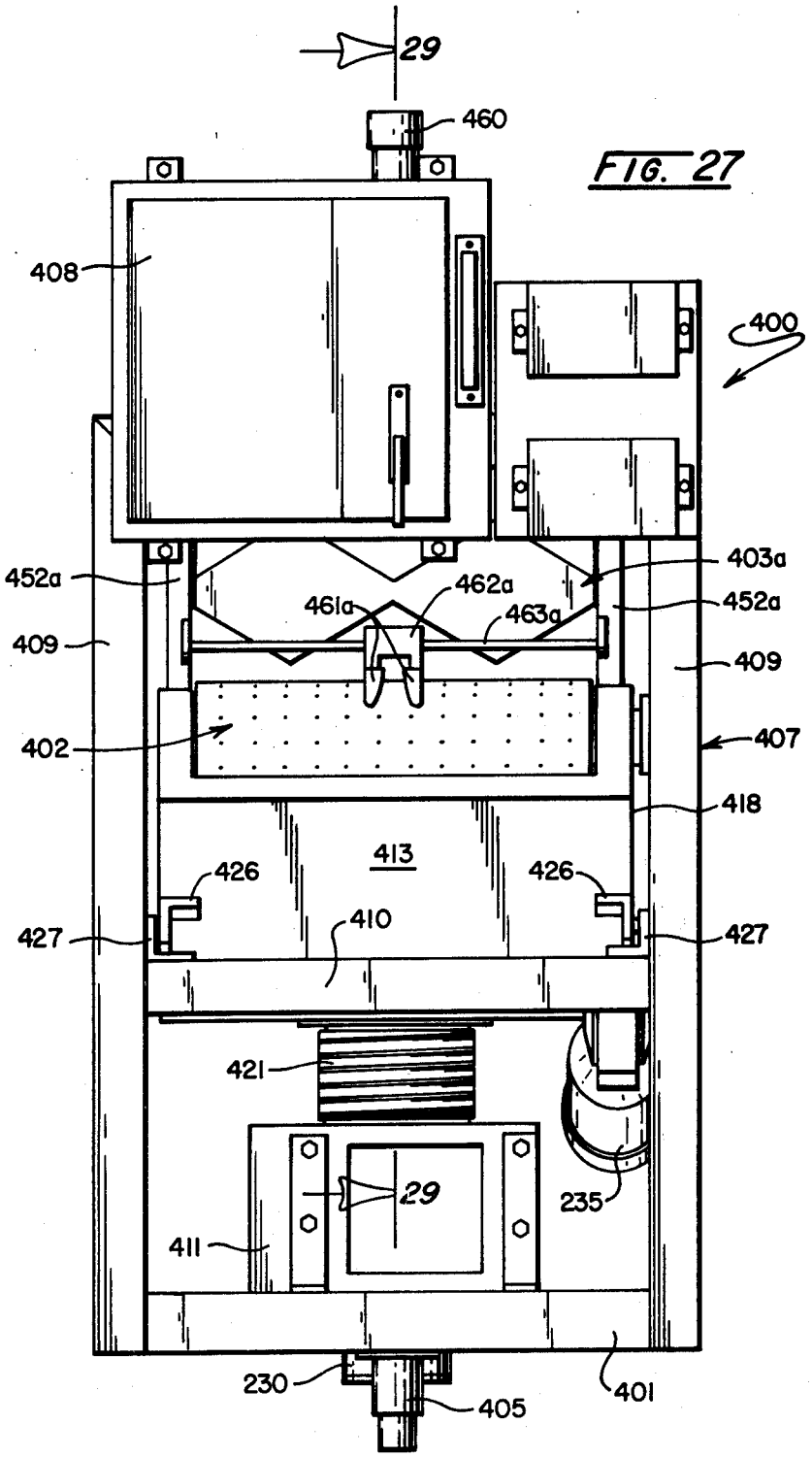
FIG. 27 is a front elevational view of the bag feeder.
Figure 28:
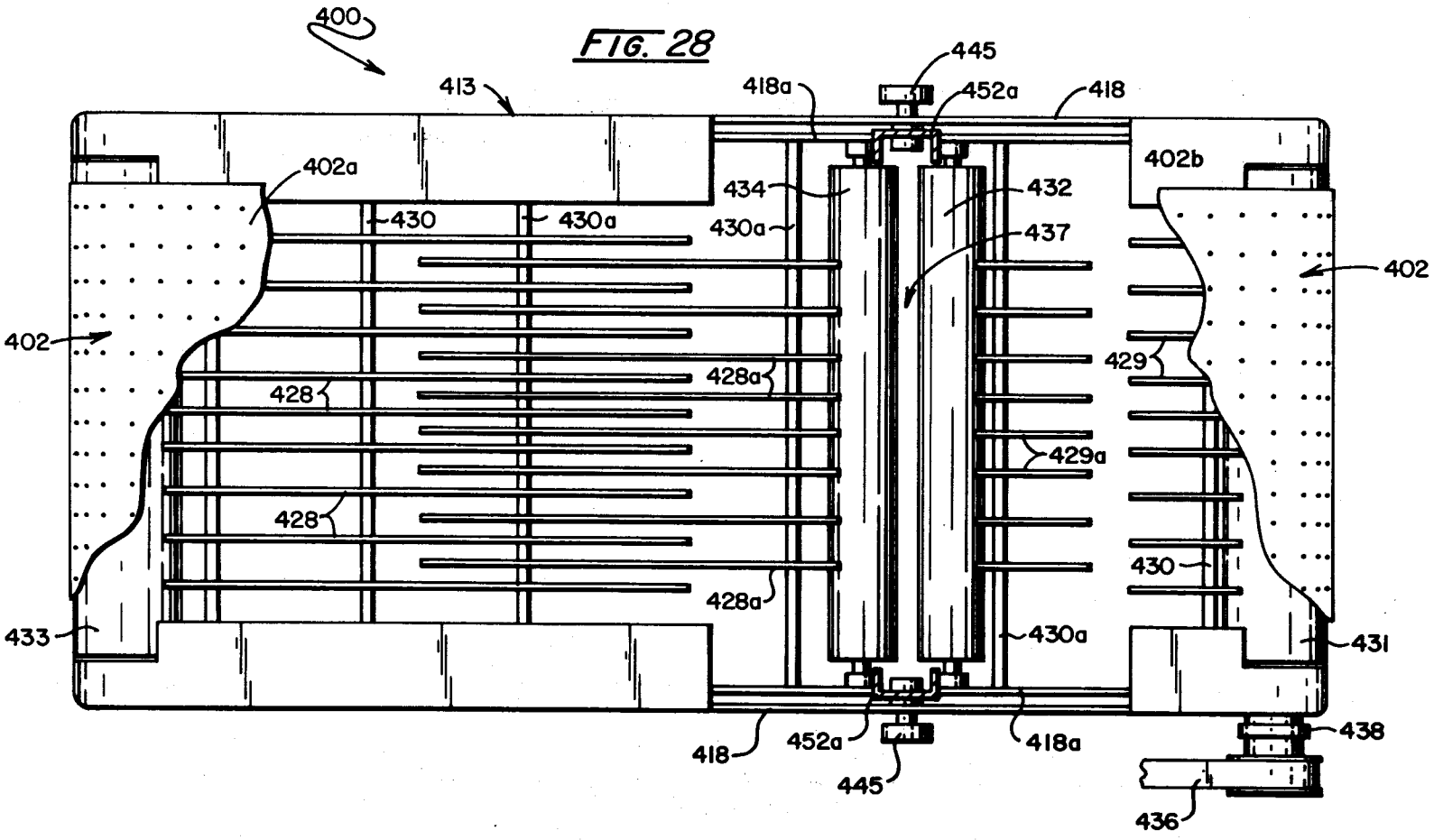
FIG. 28 is an enlarged horizontal sectional view taken along line 28—28 of FIG. 26.
Figure 29:
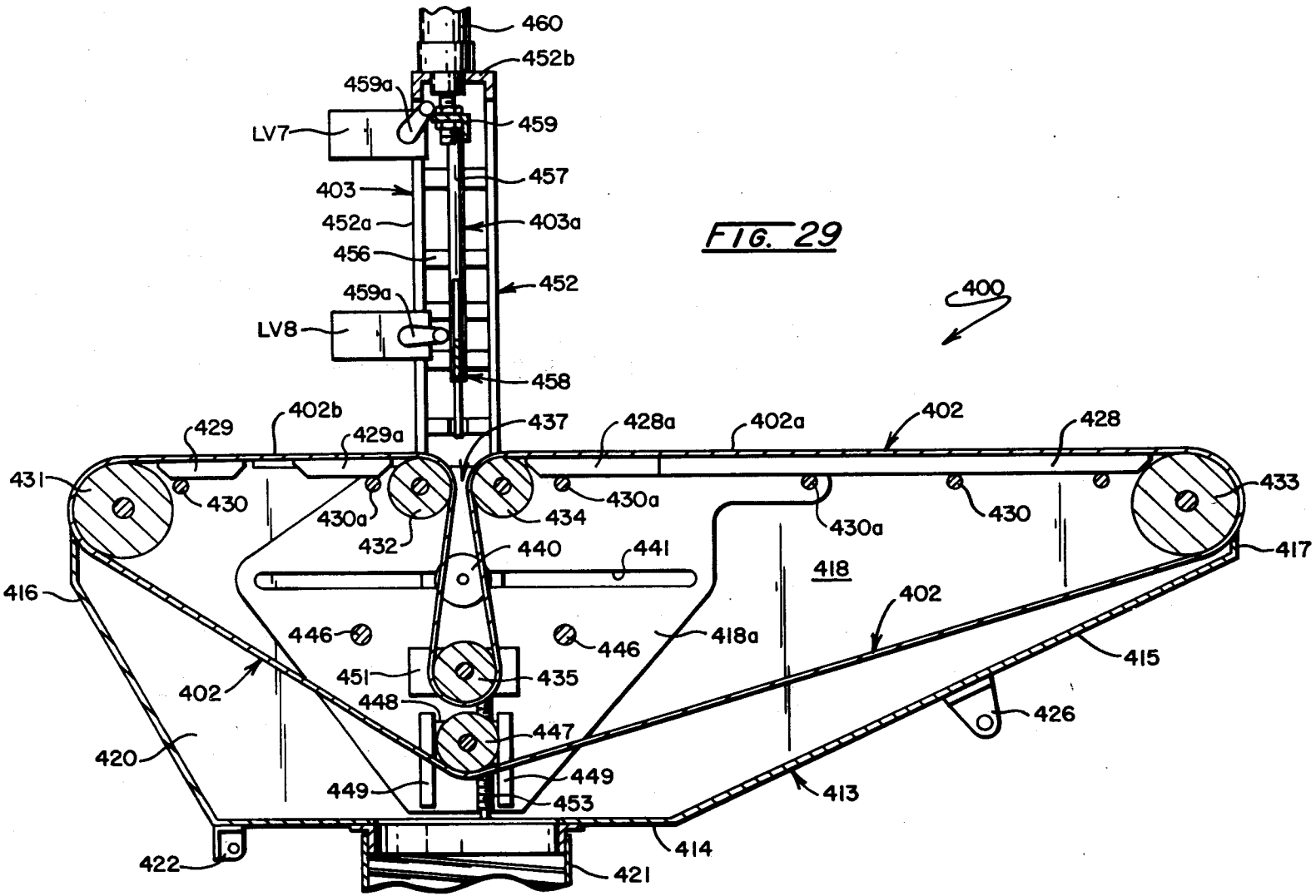
FIG. 29 is a vertical sectional view taken along line 29—29 of FIG. 27.
Figure 30:
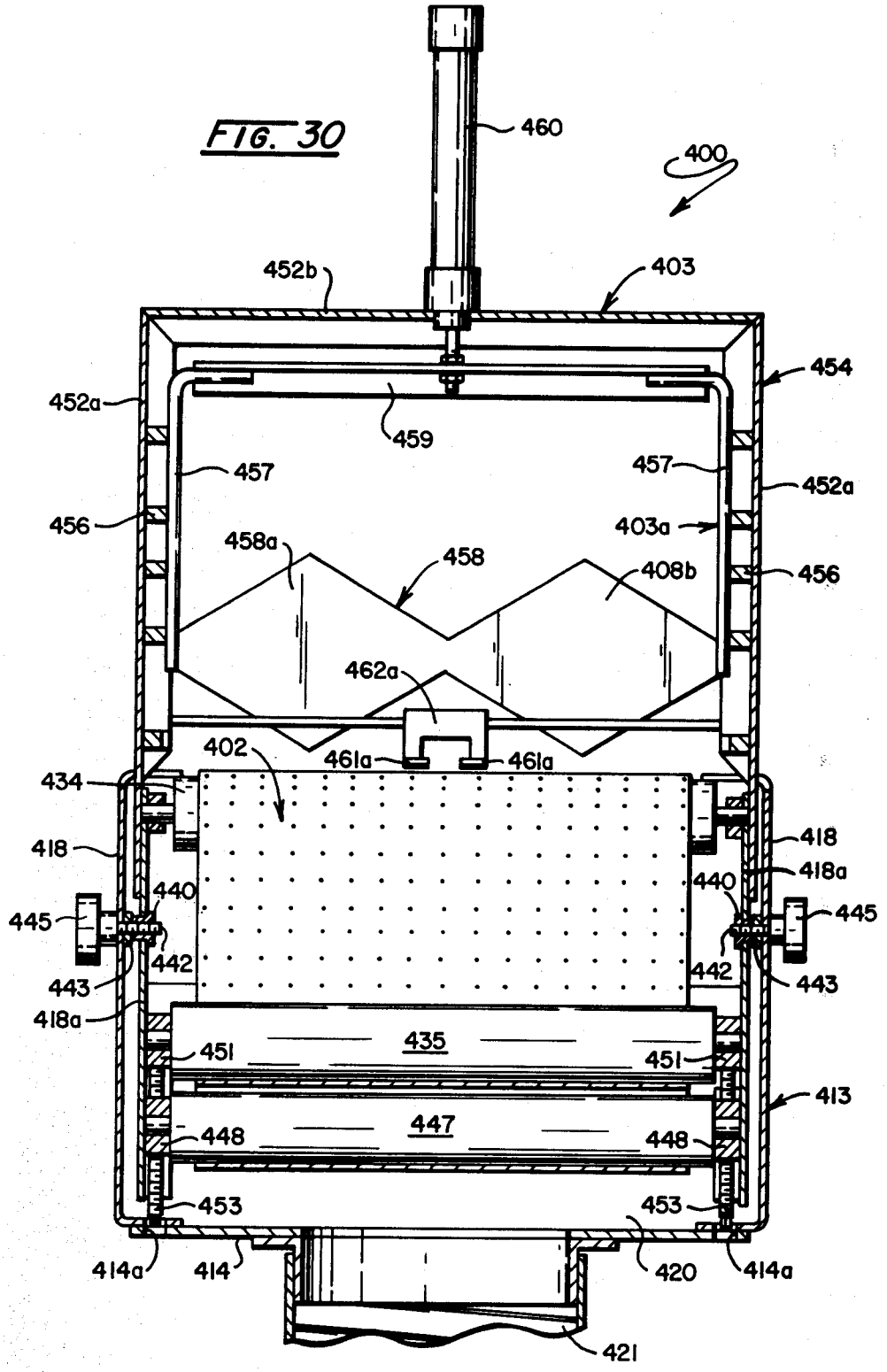
FIG. 30 is an enlarged vertical sectional view taken along line 30—30 of FIG. 26.

Vertical movement of the separator 403*a* is controlled, as indicated in FIGS. 26 and 29, by valves LV7 and LV8 which are carried on one side of the frame 452, at upper and lower levels, respectively. An actuating lever 459*a* for the valve LV7 will be engaged by crosshead 459 when it is in its uppermost position and an actuating lever 459*a* for the valve LV8 will be engaged thereby when it is in its lowermost position.

Figure 2:
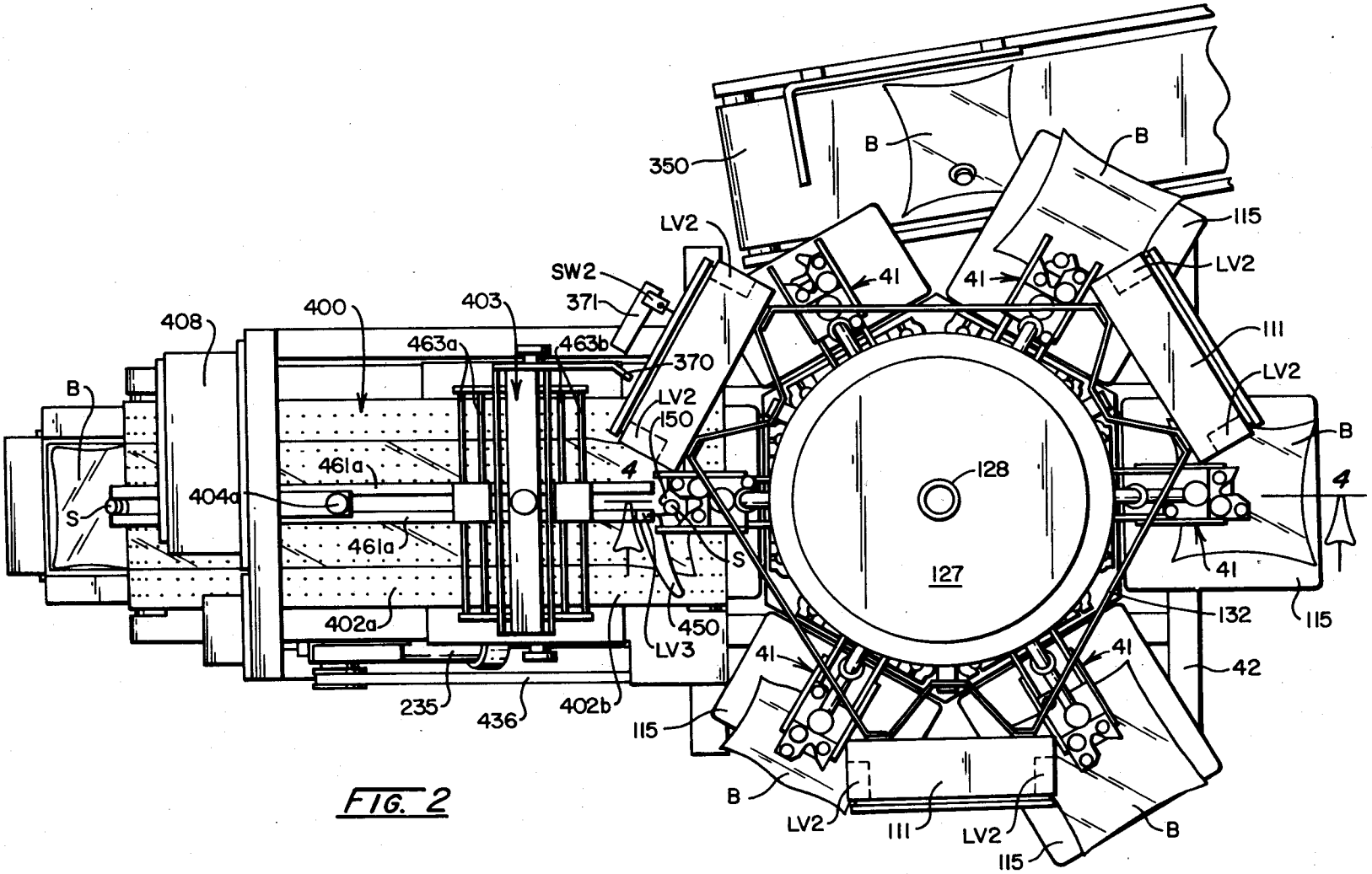
FIG. 2 is a plan view of the machine of FIG. 1.

It will be apparent that with the above automatic bag feeder 400, the motor 235, when started, will operate the drive 436 continuously. The conveyor 402 will not be driven until the clutch and brake unit 438 is actuated to release the brake and engage the clutch. This will then drive the conveyor for a predetermined period which will be set to move the bag strip T, the length of one bag B to properly bring the transverse line or seam, where separation is to occur, under the separator 403*a*. The strip T at this time is caused to adhere to the upper run of the conveyor 402 by vacuum. Each successive cap C on the spouts of the strip T first engages arm 404*c* to activate switch SWI to actuate cylinder and piston unit 404*a* to press the cap firmly down on the spout. The conveyor will stop when the bag seam is under separator 403*a* and will be held by the brake of unit 438. At this time, the cylinder and piston unit 460 will be actuated by engagement of lever 459*a* of valve LV7 to move the separator 403*a* down through the strip T to separate the leading bag ahead of it from the remaining ones behind it. The spout S on the strip T are guided to the separator by strips 461*a* and when the separator is passed, by strips 461*b*. At the time of separation, the upright spout S of the leading separated leg B will be in position to be engaged by the clamping means 150 of the approaching head 41 of the continuously counterclockwise moving turret 40, as indicated in FIG. 2. The spout is pushed into the clamp 150 by means of a cam 450 supported just above the conveyor belt section 402*b* by one of the strips 461*b*. The separator 403*a* will pass down into the gap 437. Downward movement of separator 403*a* causes engagement of lever 459*a* to activate switch LV8 to operate cylinder and piston unit 460 to move the separator upwardly through the strip T when another seam advances to gap 437. As indicated previously, the longitudinal position of the separator 403*a* and gap 437 may be simultaneously adjusted for different length bags B. The movement of the separator 403*a* and conveyor 402 will be timed by timed actuation of cylinder and piston unit 460 and clutch and brake unit 436*a*.

A valve LV3 is provided for starting the operation of the automatic bag feeder 400 in timed relationship to rotation of the turret 400 so as to present the spout S of an individual bag B to the revolving clamping means 150 as it reaches the loading station. This valve LV3 is supported (FIG. 2) by one of the guide strips 461*b* so that as the bag spout S of the leading bag passes beyond those strips, and is engaged by clamping means 150, the valve LV3 is engaged by the spout and is actuated.

As previously indicated, the electric circuit for controlling the automatic bag feeder includes the vacuum pump drive motor 230 and the conveyor drive motor 235 which may be part of the electric circuit shown in FIG. 25.

Figure 31:
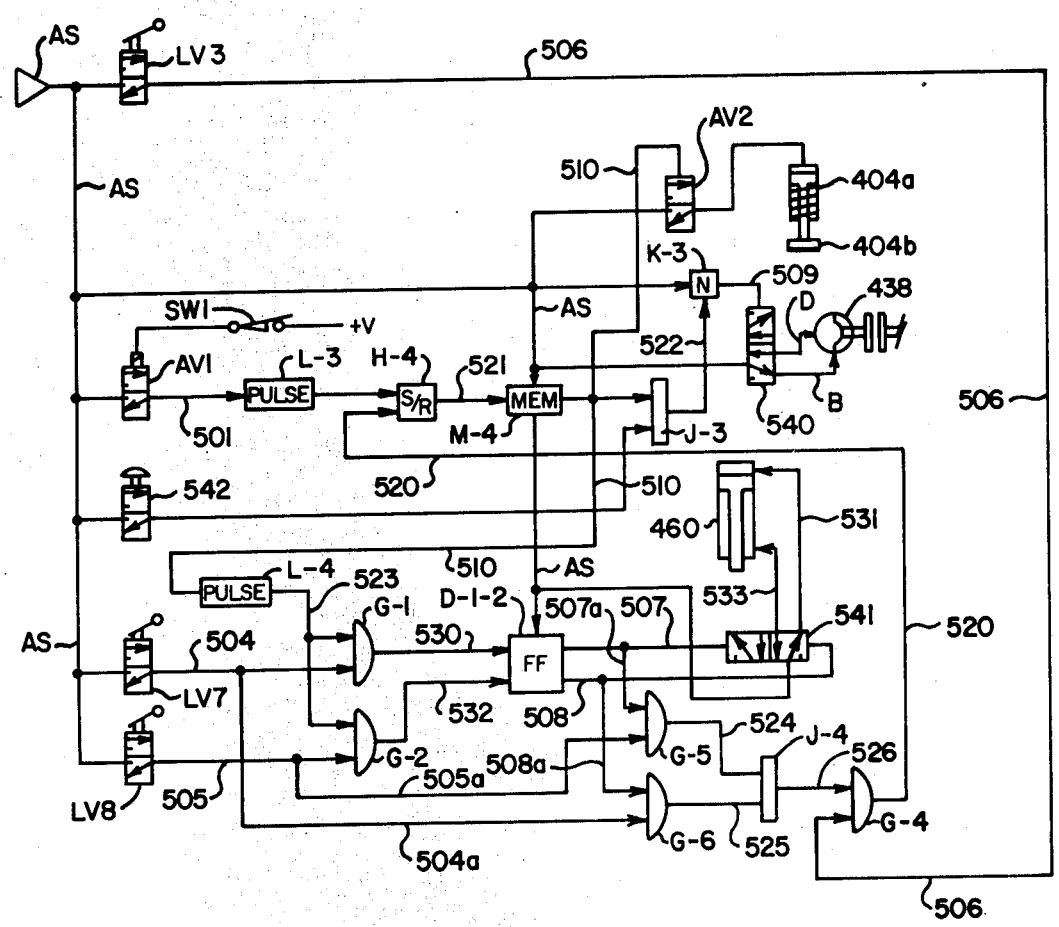
FIG. 31 is a diagram of the pneumatic control circuit for the automatic bag feeder.

A suitable pneumatic circuit for controlling the bag feeder is illustrated in FIG. 31 and will function as follows:

As indicated previously the function of the separator is to feed a continuous strip T of bags B into position, stop and separate individual bags, and feed separated bags into the rotary turret 40.

1. Output of Line 506 coming from valve LV3, which is activated by the bag spout entering the clamping means 150 on the turret 40, calls for bag making "AND" G-4 producing output in line 520 which resets "S/R" H-4 releasing trapped line 521. This shuts off line 510 which also drops off line 522 through "OR" J-3. Input in line 509 is produced from "N" K-3. Line 509 pilots four 4-way valve 540 and activates air-actuated brake and clutch 438, through Line D, driving separator conveyor 402, and moving ahead bag strip T.
2. The moving bag strip T allows a new spout S to activate AVI through switch SW1. AVI produces an unput in line 501, sending "PULSE" signal from L-3 to set "S/R" H-4 producing an output in Line 521 and through "MEM" M-4, producing an output in Line 510. Line 510 does three things: (a) pilots valve AV2, sending a shoe 404*b*, on cylinder and piston unit 404*a*, down assuring that cap C is fully on new bag spout S, (b) goes through "OR" J-3 to shut off "N" K-3 shutting off the four-way valve 540 to air brake and, clutch through Line B, stopping separator conveyor 402 and stopping the bag strip T; (c) finally sends a pulse signal 523 from "PULSE" L-4 to "AND" G-1, and G-2. When separator 403*a* is up making LV7 it will produce output in line 504 or down making LV8 it will produce output in line 505. Output in line 504 will make "AND" G-1 producing output in line 530. Output in line 530 will set Flip Flop D-1-2 causing output in line 507 causing four-way valve 541 to make output in line 531. This will activate piston of separator 460 to move down. Output in line 505 will make "AND" G-2, producing output in line 532. Output in line 532 will reset Flip Flop D-1-2 causing output in line 508 to activate four-way valve 541 to make output in line 533. This will activate piston of separator 460 to move up. Operating cylinder and piston unit 460 to send separator 403*a* up or down will separate bag B from the bag strip T. "AND" G-5 or G-6 are made by inputs 504*a* and 505*a* along with outputs 507*a* and 508*a* will produce either output 524 or 525 to produce output 526 at "OR" J-4. Pressure at 526 of "AND" G-4 waits for line 506, a call for new bag-starting cycle, through valve LV3.

3. A push-button stop valve 542 may be suitably located to stop the separator system immediately for emergency shut down.

It will be apparent from the above that with the automatic feeder and separator 400, the capped spouted flat bags B will be received as a continuous strip T and be separated into individual bags by the separator 403 and then the individual bags will be presented to the successive clamping means 150, revolving with the turret 40, as the capped spouts S thereof leave the guide strips 461*b*. The operation of the feeder and separator 400 is timed with the rotation of the turret 40, as indicated, so that the successive spouts S are engaged properly by the clamping means 150 on the successive heads 41, revolving with the turret. However, the filler machine is not limited to this particular automatic bag feeder and separator and in fact could be manually fed by successively positioning the individual capped spouted bags in similar guide strips and moving them off the strips for engagement by the successive clamping means 150 of the turret.

The rotary filler 40, being a multiple-head continuous motion machine with a minimum number of working parts, will operate smoothly at a very high capacity. It distinguishes from the form-fill prior art machines in that it fills capped spouted bags. It distinguishes generally from prior art continuous rotary fillers in that it is designed to operate on flat spouted and capped flexible bags rather than the rigid or semi-rigid containers for which the prior art rotary machines are mainly designed. Consequently, it is provided with efficient means for removing the cap from each bag spout, filling the bag, and replacing the cap after filling. It distinguishes from the fixed single-head type of the prior art which has a rotary bag feeder but is not a continuous-motion rotary filler. In applicant's machine, the capped spouted bags are presented to and clamped by the successive heads as they continuously move by a loading station and are successively filled and discharged during the continuous movement. The machine can be easily changed to receive bags of different capacities and caps of different sizes and design. It is not necessary to handle the bags during filling by equipment which engages and might damage them since the bags are held in a stationary position on a support as they are filled by the revolving filler heads which also prevents spillage. Furthermore, it is not necessary to use the bag as a measuring means, as with the rigid or semi-rigid containers, since a predetermined quantity of liquid is metered into the bag, as the filler head revolves, by means of a volume flow meter. The filling liquid may be supplied continuously to the revolving filler heads by means of gravity feed from a tank or a pressurized feed through a swivel joint which allows pressurizing of the system for flow rate control. Foam generation is prevented by providing means for making an air tight seal between the fill valve of each head and the bag spout so no air can enter the flat empty bag. Means is provided, if desired, to evacuate the bag just before filling and for topping off fill with nitrogen, or other inert gas, as fill is completed. The filler machine includes various safety features such as, re-setting the filler cycle control system after each filling, and stopping the rotation of the machine if a filled bag is not discharged. The control system is mainly a pneumatic control system, as distinguished from an electronic system, which better resists the moisture conditions encountered in the use and cleaning of a rotary filler of this type. Also, the control system is such that a section thereof may be selected for a clean-in-place operation, during which the fill valve is oscillated for flushing and no bags can be loaded into the clamping means of the heads.

In summary, the filler uncaps, fills, and recaps by each of its heads, as the heads revolve with the turret. This multiple head filling, during high-speed continuous rotation, results in high production speeds with reduced labor costs and resulting lower filling costs per container. High speed mechanical motions are eliminated, since each head operates at a smooth, relatively strain-free rate, enhancing long life of the filler and minimizing maintenance. Less damage results to "shear" sensitive products even with the high capacity because high output is maintained by the multiple heads filling smoothly and sanitarily simultaneously. The fully automatic operation of the filler establishes the production rate independent of an operator's control. The output is variable by the number of heads which are mounted on the turret and the de-activating of certain of those heads if desired.

We claim:

1. A continuous rotary filling machine for receiving flexible bags with spouts having caps thereon that are removable by relative axial movement, which comprises: a rotatable filler head support, a plurality of filler heads angularly disposed about the support and each adapted to receive a capped spouted bag, each filler head comprising means for removing and re-applying the cap on the spout and for filling the bag with a selected substance while the cap is removed, means for actuating each filler head during the continuous movement of the rotatable filler head support, said filler head actuating means including means for supplying a predetermined volume of flowable substance into the bag while the cap is removed, said substance-supplying means comprising a digitizing volume flow meter and a cooperating signal conditioner.

2. A machine according to claim 1 including bag supports mounted on the rotatable head support in cooperation with each filler head for supporting the bag as it is filled by the respective head.

3. A machine according to claim 1 in which the filler head includes means for evacuating the bag before the filling operation.

4. A machine according to claim 1 in which the filler head includes means for supplying fluid into the bag after the filling operation.

5. A machine according to claim 2 in which each of said bag supports comprises a support platform mounted on the rotatable support for movement relative to its cooperating filler head between a support and a non-support position, and means for controlling movement of said platform between said positions during the continuous rotation of said rotatable head support.

6. A continuous rotary filling machine for receiving flexible bags with spouts having caps thereon that are removable by relative axial movement, which comprises: a rotatable filler head support, a plurality of filler heads angularly disposed about the support and each adapted to receive a capped spouted bag, each filler head comprising means for removing and re-applying the cap on the spout and a filler valve for filling the bag with a selected flowable substance while the cap is removed, means for actuating each filler head during the continuous movement of the rotatable filler head support, said filler head actuating means including filler valve controlling means for supplying a predetermined volume of substance into the bag while the cap is removed, said controlling means comprising a digitizing volume flow meter and a cooperating counter which receives signals from said flow meter and upon a predetermined count closes said filler valve to interrupt flow into the bag.

7. A continuous rotary filling machine for receiving flexible bags with spouts having caps thereon that are removeable by relative axial movement, which comprises: a rotatable filler head support, a plurality of filler heads angularly disposed about the support, and means for rotating the support continuously; each filler head comprising spout-clamping means for receiving and clamping a spout, cap-engaging means for engaging the cap on the clamped spout, said spout-clamping and cap engaging means being movable relatively to move the spout and cap axially relatively, and a filler nozzle and cooperating filler valve, said filler nozzle and said clamping means being movable relatively to bring the nozzle into and out of cooperation with the bag spout; and control means for successively causing the clamping means to clamp the spout, the cap-engaging means and clamping means to move relatively to remove the cap axially from the spout, the filler nozzle and clamping means to move relatively to bring the nozzle into cooperation with the clamped spout to fill the bag and then out of cooperation with the spout, the capengaging means and spout-clamping means to move relatively to re-position the cap axially on the spout, and the clamping means to release the spout, all during the continuous rotation of the filler head support, said spout-clamping means including an open socket adapted to engage a bag-spout as the head moves past a loading position, and means at that position for presenting a bag spout to be engaged by said socket, said socket being a pivoted clamping plate in the form of an open mouth, and means for swinging said plate to closed position around the spout after it engages the spout at the loading position.

8. A machine according to claim 7 in which the bag spout is provided with a pair of axially spaced peripheral flanges and said socket engages the spout between said flanges, said means for presenting the bag spout to the socket including guide means for engaging the spout between said flanges and located in substantially the same plane as the socket.

9. A continuous rotary filling machine for receiving flexible bags with spouts having caps thereon that are removable by relative axial movement, which comprises: a rotatable filler head support, a plurality of filler heads angularly disposed about the support, and means for rotating the support continuously; each filler head comprising spout-clamping means for receiving and clamping a spout, cap-engaging means for engaging the cap on the clamped spout, said spout-clamping and cap engaging means being movable relatively to move the spout and cap axially relatively, and a filler nozzle and cooperating filler valve, said filler nozzle and said clamping means being movable relatively to bring the nozzle into and out of cooperation with the bag spout; and control means for successively causing the clamping means to clamp the spout, the cap-engaging means and clamping means to move relatively to remove the cap axially from the spout, the filler nozzle and clamping means to move relatively to bring the nozzle into cooperation with the clamped spout to fill the bag and then out of cooperation with the spout, the cap-engaging means and spout-clamping means to move relatively to re-position the cap axially on the spout, and the clamping means to release the spout, all during the continuous rotation of the filler head support, said control means including a volume flow meter for controlling the filler valve to provide a predetermined volume of liquid in the bag during the filling operation; a bag support for each filler head carried by the rotatable filler head support and supporting each clamped bag during the filling operation, each of the bag supports comprising a platform movable into and out of cooperation with its respective filler head to support the bag during the filling operation and to permit discharge thereof after the filling operation upon release by said spout clamping means.

10. A machine according to claim 9 in which said filler nozzle of each head has a second flow valve means associated therewith for controlling the pulling of vacuum in the bag before filling and the injection of fluid thereinto after filling, said control means also controlling said second valve means in its operations during the continuous rotation of the filler head support.

11. A machine according to claim 9 in which the spout-clamping means includes an open socket adapted to engage a bag-spout as the head moves past a loading position, and means at that position for presenting a bag spout to be engaged by said socket.

12. A machine according to claim 9 including safety means mounted in a fixed position relative to said rotatable filler head support for engaging a bag if it is not released by said spout-clamping means, and means actuated by said safety means to stop said means for rotating the support.

13. A machine according to claim 9 including cam means for moving said platforms into their bag-supporting and non-supporting positions during continuous rotation of the rotatable filler head support, said cam means comprising a relatively fixed cam extending around the rotatable support, and cam followers on each of said platforms for said cam.

14. A machine according to claim 9 in which the bag spout is provided with a pair of axially spaced peripheral flanges and said clamping means has jaws for engaging the spout between said flanges, said cap having a peripheral flange and said cap-engaging means having a portion engaging said flange to pull the cap from the clamped spout and a portion engaging the cap to push the cap back onto the spout.

15. A machine according to claim 14 in which the clamping means includes a removable and replaceable spout-receiving and clamping socket plate and the cap-receiving means includes a removable and replaceable cap-retainer.

16. A continuous rotary machine for receiving flexible bags with spouts having caps thereon that are removable by axial outward movement which comprises: a turret rotatable about a vertical axis, drive means for rotating the turret continuously, a plurality of angularly-disposed filler heads disposed about the turret; each filler head comprising: spout-clamping means for receiving and clamping in upright position a capped bag spout presented to it during the continuous rotaton of the turret, cap-engaging means for engaging the cap on the clamped spout mounted for vertical and horizontal movement, a filler nozzle equipped with a flow control filler valve mounted for vertical and horizontal movement relative to the clamping means for the spout; and control means for successively actuating, during the continuous rotation of the turret, the clamping means to clamp the spout, the cap-engaging means to engage the cap on the spout and to move vertically to remove it from the spout and horizontally to move it out of alignment with the spout, and the filler nozzle to move horizontally over the spout and then downwardly into filling position therewith and the filler valve to fill the bag, and, after filling, to close the valve, return the nozzle upwardly and horizontally to its original position and the cap-engaging means horizontally and downwardly to replace the cap on the spout, and the clamping means to release the spout.

17. A machine according to claim 16 including means for mounting said guide plates for radial adjustment on the turret.

18. A machine according to claim 16 in which said heads are supported in radially-extending, angularly-spaced positions on the turret, said spout-clamping means, cap-engaging means, and filler nozzle of each head being supported by a pair of laterally-spaced-radially-extending guide plates carried by the turret; said spout-clamping means comprising an oscillatable jaw-plate with a normally-outwardly-opening socket and cooperating fixed jaws carried by said guide plates, a cylinder and piston unit connected to oscillate said jaw-plate, a main support carriage mounted on said guide plates for horizontal reciprocating movement, a cap carrier, having said cap-engaging means, normally aligning with said socket and having guide portions operating in guide slots formed in said guide plates which have lower inner vertical sections and upper inclined sections, a vertically disposed cylinder and piston unit carried by the main carriage and connected to the cap carrier to move it relative to said guide plates to produce combined vertical and horizontal movement thereof resulting in horizontal movement of the main carriage, an elevator mounted for vertical movement on said main carriage and carrying said filler nozzle, and a cylinder and piston unit carried by the elevator for controlling movement of the elevator vertically and thereby the nozzle vertically into and out of filling position relative to the spout, clamped by said jaw-plate and cooperating jaws.

19. A machine according to claim 18 in which fluid lines are provided on said turret leading to the various heads and include flexible sections to permit necessary movements in the heads, means for supplying fluid from a source stationary relative to the turret, said means including a manifold at the center of the turret having relatively rotatable parts connected to the stationary source and to said lines.

20. A machine according to claim 19 in which electrical lines are provided on said turret leading to various units thereon, electric means exteriorly of said turret and stationary relative thereto, and a slip ring and brush assembly at the center of the turret for connecting said stationary electric means to the lines on the turret.

21. A machine according to claim 16 in which said control means includes a volume flow meter for controlling the filler valve to provide a predetermined volume of liquid in the bag during the filling operation.

22. A machine according to claim 21 in which the filler nozzle of each head has additional flow means associated therewith for controlling the pulling of vacuum in the bag before filling and the injection of fluid thereinto after filling; said control means also controlling said second valve means in its operation during the continuous rotation of the head support.

23. A machine according to claim 21 including a bag support mounted on the turret beneath each filler head for supporting the clamped bag during its filling by the respective filler head.

24. A machine according to claim 23 in which each of said bag supports comprises a radially-extending platform pivoted at its inner end for vertical swinging movement from a bag supporting position to a bag discharging position.

25. A machine according to claim 24 including cam means for controlling the vertical swinging of the platforms during the continuous rotation of the turret, said cam means comprising a relatively stationary cam extending around the turret, said platforms having cam followers outwardly of their pivoted inner ends for engaging said cam.

26. A machine according to claim 20 in which said turret-driving means includes an electric motor and cooperating circuit, and safety means for engaging a bag if its spout is not released from said clamping means for actuating a switch to break said circuit.

27. A machine according to claim 20 in which the spout-clamping means includes an open socket adapted to engage a bag spout as the head moves past a loading position, and means at that position for presenting a bag spout to be engaged by said socket.

28. A machine according to claim 27 in which the bag spout is provided with a pair of axially spaced peripheral flanges and said socket is in the edge of a plate which engages the spout between said flanges, said means for presenting the bag spout to the socket including guide means for engaging the spout between said flanges and located in substantially the same plane as the socket.

29. A machine according to claim 21 including means for supplying liquid to each of said heads for the filling operation, said means comprising a gravity-feed tank carried on the turret and connected to the filler nozzles of each head by flexible conduit sections to permit movement thereof on the heads.

30. A machine according to claim 21 including means for supplying liquid to each of said heads for the filling operation, said means including a pressure supply line and means for connecting said line to each of said heads, said means comprising a manifold unit on the turret between the supply lines and conduits leading to the various filler nozzles, said manifold unit including a pressure-tight swivel joint, and said conduits leading to the filler heads including flexible sections to permit movement thereof on the heads.

31. A machine according to claim 27 in which said control means comprises a pneumatic control circuit, having a valve activated by said spout as it moves into said socket.

32. A machine according to claim 31 in which said pneumatic circuit includes a spout-detecting air passage cooperating with said spout-receiving socket.

33. A machine according to claim 22 in which said control means comprises a pneumatic control circuit having a valve activated by said spout as it moves into said socket, said circuit including a spout-detecting air passage cooperating with said spout-receiving socket, and safety means to prevent actuation of the filler valve if vacuum is not detected in the bag which has its spout clamped by said clamping means.

34. A machine according to claim 32 in which said pneumatic circuit includes a clean-in-place lock-out arrangement which can be selectively actuated to open and close the filler valve during the continuous rotation of the turret and to keep the clamping means closed to prevent spouts from being clamped as the turret rotates.

35. A machine according to claim 18 including pressure means for supplying each of said nozzle members with liquid and comprising a manifold at the center of the turret connected to all of said nozzle members by conduits including flexible sections which permit the movement of the nozzle members on the turret, a stationary liquid supply line, and a leakproof swivel joint connecting said stationary supply line and said manifold.

36. A machine according to claim 35 in which resilient means acting between the main carriage and the elevator normally keeps the elevator in its uppermost position, said cylinder and piston unit carried by the elevator overcoming the resilient means to move the elevator, and filler nozzle carried thereby, downwardly.

37. A machine according to claim 36 including a reciprocable filler valve in the nozzle, and a cylinder and piston unit mounted in the cooperation with nozzle for opening or closing said valve.

38. A machine according to claim 37 including a second valve for controlling the application of fluid into the clamped spout, said last-named cylinder and piston unit also controlling the second valve.

39. A machine according to claim 35 in which said main support carriage is carried between said guide plates by rollers which operate in horizontal guide slots adjacent the upper ends thereof, and said capcarrier is positioned for vertical movement between the guide plates and the guide portions thereof being rollers which operate in the vertical and inclined portions of the cooperating slots.

40. A machine according to claim 35 in which said oscillatable plate is removable and replaceable for different size spouts.

41. A machine according to claim 40 in which said cap carrier includes a removable and replaceable cap-receiver.

42. A machine according to claim 41 in which said cap carrier has a cap-receiver and is of U-form for receiving the cap on the spout that carries it as that spout moves into the clamping means.

43. A machine according to claim 42 in which said spout has flanges engaged by the clamping plate to prevent axial movement thereof, said cap having a flange engaged by the retainer to pull the cap from the spout, and said retainer having a portion pushing on the cap to reapply it.

44. A machine according to claim 37 in which the control system is pneumatic control system connected to said spout-clamp operating cylinder and piston unit, said cylinder and piston unit for moving said cap-carrier and said cylinder and piston unit for controlling movement of said elevator; a valve controlled by the vertical position of said elevator, and another valve for starting the filling sequence which is engaged as the bag spout is moved into the clamping means of each head.

45. A machine according to claim 44 including an additional valve for each head which is engaged after each filling operation and during the continuous movement of the turret to reset the control system.

46. A machine according to claim 45 in which the turret-rotating means comprises an electric drive motor and cooperating circuit, and means beyond the clamp release position for engaging clamped bags which have not been released to break the circuit to said motor.

47. A machine according to claim 45 in which said pneumatic circuit also includes a spout-detecting air passage at said fixed jaws of the spout-clamping means.

48. A machine according to claim 47 in which said pneumatic circuit includes safety means to prevent actuation of the filler valve cylinder piston unit if no bag spout is present in said clamping means.

49. A machine according to claim 48 in which said pneumatic circuit includes a clean-in-place lock-out arrangement which can be selectively actuated to cause the filler valve cylinder and piston actuating unit to open and close the filler valve during the continuous rotation of the turret and the clamping means cylinder and piston actuating unit to keep the clamping means closed to prevent spouts from being clamped as the turret rotates.

50. A machine according to claim 18 including means for supplying each of said nozzle members with liquid; said means comprising a supply tank at the center of the turret and rotatable therewith, and conduits connecting said tank and the nozzle members and including flexible sections to permit the movement of said nozzle members on the turret.

* * * * *

UNITED STATES PATENT OFFICE

CERTIFICATE OF CORRECTION

Patent No. 4,283,901 Dated August 18, 1981

Inventor(s) Warren J. Schieser and Stanley E. Vickers

It is certified that error appears in the above-identified patent and that said Letters Patent are hereby corrected as shown below:

Column 1, line 33: change "to" to --- in ---.

Column 2, line 10: after "turret" insert --- through ---.

Column 26, lines 48 and 53: change "20" to --- 16 ---.

Column 27, lines 44 and 59: change "35" to --- 18 ---.

Column 28, line 5: change "35" to --- 18 ---.

Signed and Sealed this

*Twelfth* Day of *January 1982*

[SEAL]

*Attest:*

GERALD J. MOSSINGHOFF

*Attesting Officer* *Commissioner of Patents and Trademarks*